US010394179B1

(12) United States Patent
Kuribayashi et al.

(10) Patent No.: US 10,394,179 B1
(45) Date of Patent: Aug. 27, 2019

(54) IMAGE FORMING APPARATUS WITH CLEANING UNIT

(71) Applicant: FUJI XEROX CO., LTD., Tokyo (JP)

(72) Inventors: Masataka Kuribayashi, Kanagawa (JP); Takafumi Koide, Kanagawa (JP); Yusuke Fukuda, Kanagawa (JP); Katsuyuki Kitajima, Kanagawa (JP); Makoto Kamisaki, Kanagawa (JP); Teppei Yawada, Kanagawa (JP); Shota Oshima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/109,793

(22) Filed: Aug. 23, 2018

(30) Foreign Application Priority Data

Mar. 16, 2018 (JP) ..... 2018-049730

(51) Int. Cl.
*G03G 15/08* (2006.01)
*G03G 21/00* (2006.01)
*G03G 9/087* (2006.01)

(52) U.S. Cl.
CPC ..... *G03G 21/0011* (2013.01); *G03G 9/08755* (2013.01); *G03G 15/08* (2013.01)

(58) Field of Classification Search
CPC . G03G 21/0011; G03G 15/08; G03G 9/08755
See application file for complete search history.

(56) References Cited

U.S. PATENT DOCUMENTS

2009/0186289 A1* 7/2009 Nakamura ..... G03G 9/0806 430/108.4
2009/0233210 A1* 9/2009 Ninomiya ..... G03G 9/0819 430/109.4

FOREIGN PATENT DOCUMENTS

JP 2000-056504 2/2000
JP 2001-060055 3/2001
JP 2006-078960 3/2006

* cited by examiner

*Primary Examiner* — Susan S Lee
(74) *Attorney, Agent, or Firm* — JCIPRNET

(57) ABSTRACT

An image forming apparatus includes an image holding member, a charging unit, an electrostatic charge image forming unit, a developing unit, a transfer unit, and a cleaning unit having a cleaning blade that is in contact with the surface of the image holding member to clean the surface of the image holding member, wherein in the cleaning device, a variation in a load applied by the cleaning blade to the image holding member in a slide test is 1.5 gf/mm or less, wherein in the slide test, an image holding member which has a diameter of 30 mm and with which the cleaning blade is in contact at a contact angle of 23° and a pressing pressure of 4.0 gf/mm is rotated 100,000 times at a rotational speed of 175 mm/sec to slide the cleaning blade.

19 Claims, 6 Drawing Sheets

IMAGE FORMING APPARATUS WITH CLEANING UNIT

CROSS-REFERENCE TO RELATED APPLICATIONS

This application is based on and claims priority under 35 USC 119 from Japanese Patent Application No. 2018-049730 filed Mar. 16, 2018.

BACKGROUND

(i) Technical Field

The present invention relates to an image forming apparatus.

(ii) Related Art

An electrophotographic process for forming an image, for example, includes charging the surface of an electrophotographic photoreceptor, forming an electrostatic charge image on this surface of the electrophotographic photoreceptor on the basis of image information, developing the electrostatic charge image with a developer containing toner to form a toner image, and transferring and fixing the toner image to the surface of a recording medium.

SUMMARY

According to an aspect of the invention, there is provided an image forming apparatus including an image holding member, a charging unit that charges a surface of the image holding member, an electrostatic charge image forming unit that forms an electrostatic charge image on the charged surface of the image holding member, a developing unit that has an electrostatic charge image developer and that develops the electrostatic charge image on the surface of the image holding member with the electrostatic charge image developer to form a toner image, a transfer unit that transfers the toner image formed on the surface of the image holding member to the surface of a recording medium, and a cleaning unit having a cleaning blade that is in contact with the surface of the image holding member to clean the surface of the image holding member, wherein the electrostatic charge image developer contains toner, the toner contains an amorphous polyester resin as a binder resin, a tetrahydrofuran-soluble component of the toner particles has a weight average molecular weight Mw and a number average molecular weight Mn, the Mw is in the range of 25,000 to 60,000, Mw/Mn is in the range of 5 to 10, the ratio of the absorbance of the toner particles for a wavenumber of 1500 $cm^{-1}$ to the absorbance for a wavenumber of 720 $cm^{-1}$ is 0.6 or less, the ratio of the absorbance of the toner particles for a wavenumber of 820 $cm^{-1}$ to the absorbance for a wavenumber of 720 $cm^{-1}$ is 0.4 or less, and in the cleaning device, a variation in a load applied by the cleaning blade to the image holding member in a slide test is 1.5 gf/mm or less, wherein in the slide test, an image holding member which has a diameter of 30 mm and with which the cleaning blade is in contact at a contact angle of 23° and a pressing pressure of 4.0 gf/mm is rotated 100,000 times at a rotational speed of 175 mm/sec to slide the cleaning blade.

BRIEF DESCRIPTION OF THE DRAWINGS

Exemplary embodiments of the present invention will be described in detail based on the following figures, wherein.

DETAILED DESCRIPTION

Figure 1:
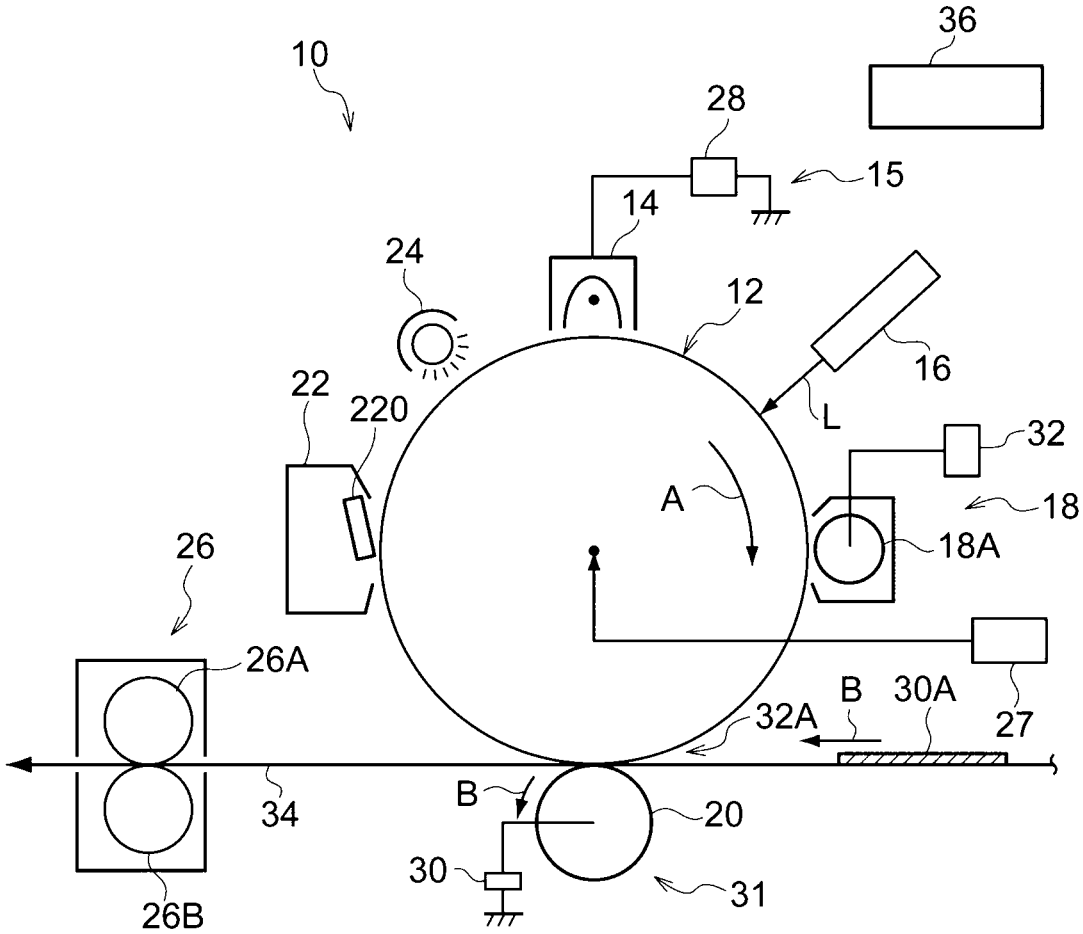
FIG. 1 schematically illustrates an example of the structure of an image forming apparatus according to exemplary embodiments.

Exemplary embodiments that are examples of the invention will now be described in detail.

An image forming apparatus according to a "first exemplary embodiment" and an image forming apparatus according to a "second exemplary embodiment" will be separately described below; however, when a description holds true for both of the exemplary embodiments, such a description simply refers to an image forming apparatus according to "exemplary embodiments".

Image Forming Apparatus

An image forming apparatus according to exemplary embodiments includes an image holding member, a charging unit that charges the surface of the image holding member, an electrostatic charge image forming unit that forms an electrostatic charge image on the charged surface of the image holding member, a developing unit that has an electrostatic charge image developer containing toner and that develops the electrostatic charge image on the surface of the image holding member with the electrostatic charge image developer to form a toner image, a transfer unit that transfers the toner image formed on the surface of the image holding member to the surface of a recording medium, and a cleaning unit that cleans the surface of the image holding member.

The toner (specific toner) contains an amorphous polyester resin as a binder resin, toner particles, and an external additive. When the tetrahydrofuran-soluble component of the toner particles (also referred to as "THF-soluble component") is analyzed by gel permeation chromatography (GPC) to determine a weight average molecular weight Mw and a number average molecular weight Mn, Mw is in the range of 25,000 to 60,000, and Mw/Mn is in the range of 5 to 10. In addition, when the toner particles are analyzed by infrared absorption spectrometry, the ratio of absorbance for a wavenumber of 1500 $cm^{-1}$ to absorbance for a wavenumber of 720 $cm^{-1}$ is 0.6 or less, and the ratio of absorbance for a wavenumber of 820 $cm^{-1}$ to absorbance for a wavenumber of 720 $cm^{-1}$ is 0.4 or less.

In the image forming apparatus according to the first exemplary embodiment, the cleaning unit has a cleaning blade that is in contact with the surface of the image holding member to clean the image holding member, and the difference in a load applied by the cleaning blade to the image holding member between before and after the slide test specified below is 1.5 gf/mm or less.

Slide Test

In a state in which the cleaning blade is in contact with an image holding member having a diameter of 30 mm at a contact angle of 23° and a pressing pressure of 4.0 gf/mm, the image holding member is rotated 100,000 times at a rotational speed of 175 mm/sec to slide the cleaning blade.

In the image forming apparatus according to the second exemplary embodiment, the cleaning device includes a cleaning blade of which a corner of one end (contact corner) is in contact with the image holding member to clean the image holding member, a supporting member which supports the cleaning blade and which is disposed so as to be movable in the direction in which the vibration of the cleaning blade that slides on the image holding member is absorbed, and a pressing unit having an elastic member that is pressed against the supporting member to press the supporting member so that the cleaning blade is pressed against the image holding member in the direction in which the supporting member can move.

In the image forming apparatuses having such structures according to the first and second exemplary embodiments, the degradation of cleaning performance can be reduced even after repeated formation of images.

The mechanism thereof is speculated as follows.

In electrophotographic image forming apparatuses, an electrostatic charge image formed on the surface of the image holding member is developed with a developer containing toner to form a toner image, the toner image is transferred from the image holding member to the surface of a recording medium, and then the toner image is fixed to form an image on the recording medium. The surface of the image holding member is cleaned with a cleaning unit to remove a residual toner, which has not been transferred, after the transfer of the toner image. Such a cleaning unit is the cleaning unit having the cleaning blade that is in contact with the surface of the image holding member to clean the image holding member.

The term "specific toner" refers to toner containing toner particles of which analysis by infrared absorption spectrometry shows that the ratio of absorbance for a wavenumber of 1500 $cm^{-1}$ to absorbance for a wavenumber of 720 $cm^{-1}$ is 0.6 or less and that the ratio of absorbance for a wavenumber of 820 $cm^{-1}$ to absorbance for a wavenumber of 720 $cm^{-1}$ is 0.4 or less. Such infrared absorption spectrum characteristics of the toner particles mean that the amorphous polyester resin used as a binder resin does not contain an alkylene oxide adduct of bisphenol A (such as ethylene oxide adduct of bisphenol A, propylene oxide adduct of bisphenol A, or ethylene oxide-propylene oxide adduct of bisphenol A) as a polyhydric alcohol or contain it in a slight amount if any.

In order to enhance the fixability of a fixed image in which the specific toner is used, the weight average molecular weight Mw and number average molecular weight Mn of a tetrahydrofuran-soluble component contained in the toner particles, which are determined by gel permeation chromatography, are suitably adjusted to be as follows: Mw is from 25,000 to 60,000, and Mw/Mn is from 5 to 10. In particular, it is suitable that a non-cross-linked binder resin component principally have such molecular weight characteristics.

Specifically, in the case where the Mw is less than 25,000, hot offset (phenomenon in which toner unnecessarily melts and adheres to fixing members) is likely to occur in a fixing process; in the case where the Mw is greater than 60,000, the lower limit of the fixing temperature is likely to be enhanced. In the case where the Mw/Mn is greater than 10, the resins have a difference in meltability, which results in that a fixed image is likely to have unevenness. Adjusting the Mw/Mn to be less than 5 is difficult for the convenience of a production process.

The specific toner (toner particles thereof) having the above-mentioned molecular weight characteristics enables an enhancement in the fixability of an image.

When the cleaning unit having the cleaning blade that is in contact with the surface of the image holding member is employed and the specific toner is used, cleaning performance may degrade after repeated formation of images, namely after long-term use. The cause thereof is presumed as follows.

The specific toner has a high moisture absorbing property attributed to the amorphous polyester resin, and the toner particles that have absorbed moisture are likely to be plasticized. In particular, the toner particles are more likely to be clearly plasticized in a high temperature and high humidity environment (for example, temperature of 28° C. and humidity of 85%). In the plasticized toner particles, an external additive existing on their surfaces is easily embedded thereinto owing to, for instance, mechanical stress. The external additive embedded into the surfaces of the toner particles is hard to be separated from the toner particles; hence, the more the toner particles become plasticized, the more the supply of a separated external additive to the contact area in which the image holding member is in contact with the contact corner of the cleaning blade is reduced. A load applied to the contact corner of the cleaning blade that is in contact with the image holding member therefore increases. Such an increase in the load in the contact area in which the image holding member is in contact with the contact corner of the cleaning blade leads to increased wear of the cleaning blade; thus, cleaning performance degrades after the cleaning blade is further worn because of repeated formation of images.

In the image forming apparatus according to the first exemplary embodiment, a cleaning member in which the difference in a load applied by the cleaning blade to the image holding member between before and after the above-mentioned slide test is 1.5 gf/mm or less is used.

The cleaning blade is in contact with the surface of the rotationally driven image holding member and scrapes toner or another substance remaining on the surface of the image holding member to clean the surface of the image holding member with friction being generated therebetween. Since the friction is generated between the cleaning blade and the surface of the image holding member, the cleaning blade slightly vibrates in the rotational direction of the image holding member in a state in which it is in contact with the image holding member. In the case where the amount of an external additive supplied to the contact area in which the image holding member is in contact with the contact corner of the cleaning blade decreases, the friction generated therebetween increases, and the cleaning blade therefore further vibrates; thus, the contact posture of the cleaning blade to the image holding member becomes unstable. Then, a load applied to the cleaning blade increases, and the contact corner of the cleaning blade therefore further wears.

In the case where the difference in a load applied by the cleaning blade to the image holding member between before and after the slide test is within the above-mentioned range, a load applied to the contact corner of the cleaning blade is stable even after repeated formation of images.

Accordingly, even when use of the specific toner reduces the amount of an external additive supplied to the contact area in which the image holding member is in contact with the contact corner of the cleaning blade, a load applied to the contact corner of the cleaning blade is stable, and the contact posture of the cleaning blade to the surface of the image holding member is also stable. As a result, a load applied to the cleaning blade is less likely to increase, and the wear of the cleaning blade therefore decreases, so that high cleaning performance is maintained for a long period of time.

The cleaning device used in the image forming apparatus according to the second exemplary embodiment includes a cleaning blade of which a corner of one end (contact corner) is in contact with the image holding member to clean the image holding member, a supporting member which supports the cleaning blade and which is disposed so as to be movable in the direction in which the vibration of the cleaning blade that slides on the image holding member is absorbed, and a pressing unit having an elastic member that is pressed against the supporting member to press the supporting member so that the cleaning blade is pressed against the image holding member in the direction in which the supporting member can move.

The supporting member is movable in the direction in which the vibration of the cleaning blade that slides on the image holding member is absorbed, and this refers to the following: the cleaning blade vibrates when it slides on the image holding member, and the supporting member can move during the vibration of the cleaning blade in the direction in which the cleaning blade vibrates. The elastic member is pressed against the supporting member by the pressing unit to press the supporting member so that the cleaning blade is pressed against the image holding member in the direction in which the supporting member can move; hence, the elasticity of the elastic member that presses the supporting member enables the vibration of the cleaning blade to be absorbed by the supporting member. A load applied to the cleaning blade is also absorbed by the supporting member, which leads to a reduction in the load applied to the cleaning blade.

As a result, even when use of the specific toner reduces the amount of an external additive supplied to the contact area in which the image holding member is in contact with the contact corner of the cleaning blade, a load applied to the contact corner of the cleaning blade is stable, and the contact posture of the cleaning blade to the surface of the image holding member is also stable. Accordingly, a load applied to the cleaning blade is less likely to increase, and the wear of the cleaning blade therefore decreases, so that high cleaning performance is maintained for a long period of time.

In the image forming apparatus according to the exemplary embodiments (first and second exemplary embodiments), the degradation of cleaning performance is reduced even after images are repeatedly formed.

The structure of the image forming apparatus of the exemplary embodiments will now be described in detail.

Structure of Image Forming Apparatus

The image forming apparatus according to the exemplary embodiments includes the image holding member, the charging unit that charges the surface of the image holding member, the electrostatic charge image forming unit that forms an electrostatic charge image on the charged surface of the image holding member, the developing unit that has an electrostatic charge image developer containing the specific toner and that develops the electrostatic charge image on the surface of the image holding member with the electrostatic charge image developer to form a toner image, the transfer unit that transfers the toner image formed on the surface of the image holding member to the surface of a recording medium, and the cleaning unit having the cleaning blade that is in contact with the surface of the image holding member to clean the surface of the image holding member.

In the cleaning unit used in the first exemplary embodiment, the difference in a load applied by the cleaning blade to the image holding member between before and after the slide test is within the above-mentioned range.

The cleaning unit used in the second exemplary embodiment includes the following members.

Cleaning blade of which the corner of one end is in contact with the image holding member to clean the image holding member Supporting member that supports the cleaning blade and that is disposed so as to movable in the direction in which the vibration of the cleaning blade that slides on the image holding member is absorbed Pressing unit having an elastic member that is pressed against the supporting member to press the supporting member so that the cleaning blade is pressed against the image holding member in the direction in which the supporting member can move In the first exemplary embodiment, it is suitable that the cleaning unit include the cleaning blade, supporting member, and pressing member each having the above-mentioned structure.

In the cleaning unit used in the second exemplary embodiment, it is suitable that the difference in a load applied by the cleaning blade to the image holding member between before and after the slide test be within the above-mentioned range.

The image forming apparatus of the exemplary embodiments may be any of the following known image forming apparatuses: a direct transfer type apparatus in which the toner image formed on the surface of the image holding member is directly transferred to a recording medium, an intermediate transfer type apparatus in which the toner image formed on the surface of the image holding member is transferred to the surface of an intermediate transfer body (first transfer) and in which the toner image transferred to the surface of the intermediate transfer body is then transferred to the surface of a recording medium (second transfer), and an apparatus which has an erasing unit that radiates light to the surface of the image holding member for removal of charges after the transfer of the toner image and before charging.

The image forming apparatus according to the exemplary embodiments, which satisfy the above description about both the first and second exemplary embodiments, will now be described with reference to the drawings.

The image forming apparatus according to the exemplary embodiments is, however, not limited to the following description and structure. Only the parts illustrated in the drawings will be described, and description of the other parts is omitted.

FIG. 1 schematically illustrates an example of the structure of the image forming apparatus according to the exemplary embodiments.

An image forming apparatus 10 according to the exemplary embodiments, for instance, includes an image holding member 12 as illustrated in FIG. 1. The image holding member 12 is cylindrical and connected to a driving portion 27, such as a motor, via a driving force transmitting member (not illustrated) such as a gear. The image holding member 12 is rotationally driven by the driving portion 27 around the rotation axis indicated by the black point. In the example in FIG. 1, The image holding member 12 is rotationally driven in the direction indicated by the arrow A.

In the vicinity of the image holding member 12, for example, a charging device 15 (example of the charging unit), an electrostatic charge image forming device 16 (example of the electrostatic charge image forming unit), a developing device 18 (example of the developing unit), a transfer device 31 (example of the transfer unit), a cleaning device 22 (example of the cleaning unit), and a charge erasing device 24 are disposed in sequence along the rotational direction of the image holding member 12. The image forming apparatus 10 also includes a fixing device 26 having a fixing member 26A and a pressing member 26B disposed in contact with the fixing member 26A. The image forming apparatus 10 also includes a controller 36 that controls the operation of each of the devices (parts). A unit including the image holding member 12, the charging device 15, the electrostatic charge image forming device 16, the developing device 18, the transfer device 31, and the cleaning device 22 is an image forming unit.

In the image forming apparatus 10, at least the image holding member 12 may be integrated with another device to form a process cartridge.

Each of the devices (parts) of the image forming apparatus 10 will now be described in detail.

Cleaning Device

The cleaning device 22 is disposed downstream of a transfer region 32A in the rotational direction of the image holding member 12. The cleaning device 22 removes a residual toner adhering to the image holding member 12, namely cleans the image holding member 12, after a toner image is transferred to a recording medium 30A. The cleaning device 22 removes not only a residual toner but also other substances remaining on the image holding member 12, such as paper dust.

Structure of Cleaning Device

The cleaning device 22 will now be described with reference to FIG. 2.

Figure 2:
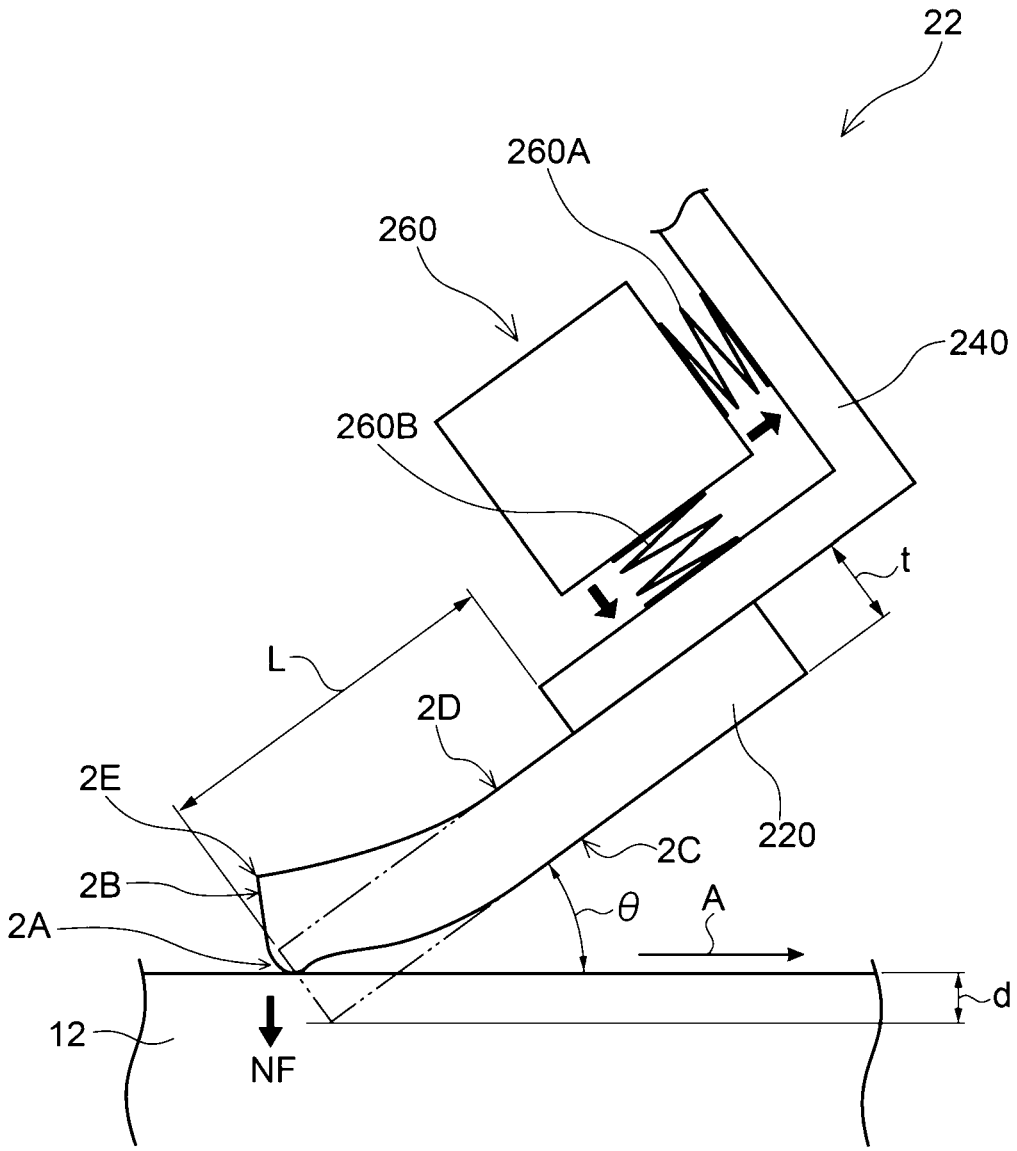
FIG. 2 is a schematic cross-sectional view illustrating an example of the structures of an image holding member and cleaning device in the image forming apparatus according to the exemplary embodiments.

FIG. 2 schematically illustrates the structure and position of a cleaning blade 220 used in the cleaning device 22 in FIG. 1.

Parts of the cleaning blade 220 will now be described. As illustrated in FIG. 2, the cleaning blade 220 has a contact corner 2A that is in contact with the image holding member 12 in a driving mode to clean the surface of the image holding member 12, an end surface 2B of which one side corresponds to the contact corner 2A and which faces upstream in the driving direction of the image holding member 12 (direction indicated by the arrow A), an under surface 2C of which one side corresponds to the contact corner 2A and which faces downstream in the driving direction of the image holding member 12, a back surface 2D which shares one side with the end surface 2B and which is opposite to the under surface 2C, and a non-contact angle 2E which is opposite to the contact angle 2A on the end surface 2B and at which the end surface 2B is in contact with the back surface 2D.

In the cleaning device 22, the cleaning blade 220 is disposed such that one end (end surface 2B) thereof faces counter to the driving direction of the image holding member 12 (direction indicated by the arrow A), and one corner (contact corner 2A) of the end surface 2B is in contact with the image holding member 12 to remove a substance remaining on the surface of the image holding member 12.

The back surface 2D of the cleaning blade 220 is attached to a supporting member 240 on the side opposite to the end surface 2B being in contact with the image holding member 12, and the cleaning blade 220 is supported by the supporting member 240 in this manner. The supporting member 240 in FIG. 2 has an L shape and is formed of metal (for instance, a metal material such as aluminum or stainless steel). An adhesive layer formed of an adhesive or another material may be provided between the supporting member 240 and the cleaning blade 220 to attach them to each other.

The cleaning blade 220 is in contact with the image holding member 12 that is rotationally driven in the direction indicated by the arrow A, and friction is generated therebetween. Hence, the cleaning blade 220 is in contact with the image holding member 12 while it slightly vibrates in the rotational direction of the image holding member 12.

In the exemplary embodiments, the supporting member 240 is disposed so as to be movable in the direction in which the vibration of the cleaning blade 220 sliding on the image holding member 12 is absorbed.

A pressing member 260 (example of the pressing unit) having elastic members 260A and 260B is provided, and the elastic members 260A and 260B are pressed against the supporting member 240. The elastic members 260A and 260B of the pressing member 260 are pressed in this manner, and thus the supporting member 240 is pressed so that the cleaning blade 220 is pressed against the image holding member 12 in the direction in which the supporting member 240 can move. In FIG. 2, the elastic member 260B is pressed against the L-shaped supporting member 240 at one point on the side opposite to the side attached to the cleaning blade 220 in the direction indicated by the arrow, and the elastic member 260A is pressed against the supporting member 240 at one point on the bottom side of the L shape in the direction indicated by the arrow.

An example of the elastic members 260A and 260B of the pressing member 260 is a spring member in FIG. 2. Other examples thereof include a rubber member and a resin member. In particular, a spring member is suitable.

Operation of Cleaning Device

The operation of the cleaning device 22 illustrated in FIG. 2 will now be described.

The cleaning blade 220 is in contact with the surface of the image holding member 12 that is rotationally driven in the direction indicated by the arrow A, and friction is generated therebetween. The cleaning blade 220 is in contact with the image holding member 12 while it slightly vibrates in the rotational direction of the image holding member 12. In the case where the specific toner is used and where the amount of an external additive supplied to the contact area in which the image holding member 12 is in contact with the contact corner 2A of the cleaning blade 220 is reduced, the friction generated therebetween increases, and the cleaning blade 220 therefore further vibrates.

A typical cleaning device 122 illustrated in FIG. 6 will now be described. In the cleaning device 122, a supporting member 340 that supports a cleaning blade 320 is fixed and cannot move in the direction in which the vibration of the cleaning blade 320 sliding on the image holding member 12 is absorbed. Since the supporting member 340 is fixed, the vibration of the cleaning blade 320 sliding on the image holding member 12 is not absorbed by the supporting member 340. Hence, the vibration is generated only in the cleaning blade 320 as indicated by the double-dashed chain line in FIG. 6. A load that the vibration gives to the cleaning blade 320 is not absorbed by the supporting member 340, and only the cleaning blade 320 bears the load.

Thus, the cleaning blade 320 bears an increased load and therefore further wears, which results in reduced cleaning performance in some cases after repeated formation of images.

In the cleaning device 22 illustrated in FIG. 2, the supporting member 240 can move in the direction in which the vibration of the cleaning blade 220 sliding on the image holding member 12 is absorbed. The elastic members 260A and 260B are pressed by the pressing member 260 against the supporting member 240 to press the supporting member 240 so that the cleaning blade 220 is pressed against the image holding member 12 in the direction in which the supporting member 240 can move. The elasticity of the elastic members 260A and 260B that press the supporting member 240 enables the vibration of the cleaning blade 220 to be absorbed by the supporting member 240. In particular, the supporting member 240 also vibrates along with the cleaning blade 220 as indicted by the double-dashed chain line in FIG. 3. The load applied to the cleaning blade 220 is also absorbed by the supporting member 240, and the load to be applied to the cleaning blade 220 is therefore reduced.

As a result, even when use of the specific toner reduces the amount of an external additive supplied to the contact area in which the image holding member 12 is in contact with the contact corner 2A of the cleaning blade 220, a load applied to the cleaning blade 220 is stable. Thus, the wear of the cleaning blade 220 decreases, so that the degradation of cleaning performance is reduced even after images are repeatedly formed.

Characteristics

In the cleaning device 22 illustrated in FIG. 2, the difference in a load applied by the cleaning blade 220 to the image holding member 12 between before and after the slide test specified below is 1.5 gf/mm or less. At the difference in a load within such a range, the degradation of cleaning performance is reduced even after images are repeatedly formed.

The difference in a load is preferably 1.3 gf/mm or less, and more preferably 1.1 gf/mm or less.

Slide Test

In a state in which the cleaning blade is in contact with an image holding member having a diameter of 30 mm at a contact angle of 23° and a pressing pressure of 4.0 gf/mm, the image holding member is rotated 100,000 times at a rotational speed of 175 mm/sec to slide the cleaning blade.

Further specific conditions of the slide test are as follows. The cleaning blade is brought into contact with an image holding member used in a modified machine of APEO-SPORT-V C2275 manufactured by Fuji Xerox Co., Ltd. at a contact angle of 23° C. and a pressing pressure of 4.0 gf/mm. The modified machine is operated at a process speed of 175 mm/sec. Toner is supplied from a developing device to the image holding member. In particular, 2.0 g of the toner is supplied per 100 times of rotation of the image holding member while development potential is controlled in the modified machine; in this state, the slide test is performed for 100,000 times of rotation of the image holding member.

The load applied by the cleaning blade to the image holding member is measured as follows.

The cleaning blade is brought into contact with a load measuring apparatus having a load cell and a metal plate disposed thereon and is fixed at a contact angle of 23° with a fixing jig. The position of the cleaning blade in the direction vertical to the plate is changed, and the amount of entry that gives 4.0 gf/mm is determined.

Pressing Pressure NF

The force NF (Normal Force) at which the cleaning blade 220 is pressed against the image holding member 12 in the exemplary embodiments is preferably in the range of 1.0 gf/mm to 4.0 gf/mm, more preferably 1.2 gf/mm to 3.7 gf/mm, and further preferably 1.3 gf/mm to 3.5 gf/mm in order to give cleaning performance sufficient for an object that is to be removed (such as residual toner) and to reduce the wear of the cleaning blade 220.

The pressing pressure NF of the cleaning blade 220 is calculated from the following equation.

$$NF=dEt^3/4L^3$$

In the equation, d represents the entry amount d of the cleaning blade 220 illustrated in FIG. 2, E represents the Young's modulus of the cleaning blade 220, t represents the thickness t of the body of the cleaning blade 220 illustrated in FIG. 2, and L represents the free length L of the cleaning blade 220 illustrated in FIG. 2 (length of the part that is not fixed by the supporting member 240).

The Young's modulus (E) of the cleaning blade 220 is calculated from the following equation through determining a force ΔS applied to a unit cross-sectional area and elongation Δa at a unit length.

$$E=\Delta S/\Delta a$$

ΔS is determined as follows from a load F, the thickness t of a sample, and the width w of the sample; and Δa is determined as follows from the standard length L of a sample and the elongation ΔL of the sample in application of a load.

$$\Delta S=F/(w\times t)$$

$$\Delta a=\Delta L/L$$

In the measurement of Young's modulus, a tensile tester (tensile tester MODEL-1605N manufactured by Aikoh Engineering Co., Ltd.) is used.

Entry Amount d

The amount of the entry of the cleaning blade 220 to the image holding member 12 (entry amount d in FIG. 2) is preferably in the range of 0.2 mm to 1.5 mm, and more preferably 0.4 mm to 1.2 mm to give cleaning performance sufficient for an object that is to be removed (such as residual toner) and to reduce the wear of the cleaning blade 220.

Contact Angle θ

The contact angle of the cleaning blade 220 to the image holding member 12 (contact angle θ in FIG. 2) is preferably from 10° to 27°, more preferably from 12° to 25°, and further preferably from 15° to 25°.

At a contact angle θ within such a range, a performance for removing a residual toner is enhanced, and the action of a local force on the surface of the image holding member 12 is reduced, which leads to a reduction in the local wear of the image holding member 12.

The contact angle θ refers to the following angle: in a state in which the cleaning blade 220 is in contact with the image holding member 12 as illustrated in FIG. 2, a virtual line is drawn from the non-bent part of the under surface 2C of the cleaning blade 220, and the angle (acute angle) defined by the virtual line and the surface of the image holding member 12 is referred to as contact angle θ.

Structure of Cleaning Blade

The cleaning blade 220 is suitably an elastic body. Specifically, the cleaning blade 220 is suitably an elastic plate.

Material

The material used for forming the cleaning blade 220 is suitably a resin composition principally containing a thermoplastic resin.

The term "principally containing" refers to that the amount of the thermoplastic resin is preferably at least 50 mass % or more, more preferably 80 mass % or more, further preferably 90 mass % or more, and especially preferably 100 mass % or more in the resin composition.

The resin composition may contain a known additive in addition to the thermoplastic resin.

The thermoplastic resin is suitably a crystalline resin in terms of formability, wear resistance, slidability, and hardness. Examples of the crystalline resin include polyacetal (POM), polypropylene (PP), polyethylene (PE), polyamide (PA), polybutylene terephthalate (PBT), polyethylene terephthalate (PET), polyphenylene sulfide (PPS), polyether etherketone (PEEK), liquid crystal polymer (LCP), and fluorocarbon resin [such as polytetrafluoroethylene (PTFE), perfluoroalkoxy alkane (PFA)].

Examples of other materials that can be suitably used for forming the cleaning blade 220 include polyurethanes (such as polyurethanes produced by polymerization of polyisocyanate with polyol), silicone rubbers, and butadiene rubbers.

In particular, polyacetal, polyphenylene sulfide, polyether ether ketone, liquid crystal polymer, and polyurethane are suitable in terms of wear resistance and slidability.

Elastic Modulus

The cleaning blade 220 preferably has a tensile elasticity ranging from 20 MPa to 4000 MPa, more preferably from 40 MPa to 3000 MPa, and further preferably from 60 MPa to 2500 MPa as the index of elasticity.

At a tensile elasticity of 20 MPa or more, the cleaning blade 220 has an enhanced hardness and excellent wear resistance.

The tensile elasticity is measured in accordance with JIS K7161 with an INSTRON tester 5566 (commercially available from Toyo Seiki Seisaku-sho, Ltd.), and a strip-shaped test piece (width: 6 mm, length: 130 mm, type-one dumbbell test piece) is subjected to the measurement at a test speed of 500 mm/min and a measurement number n of 5.

Another Example of Cleaning Blade

In the case where the cleaning blade 220 has a layered structure, the contact corner 2A that is in contact with the image holding member 12 suitably has a larger micro hardness than the non-contact corner 2E that is opposite to the contact corner 2A on the same end surface (end surface 2B) and that does not contact with the image holding member 12.

Since the contact corner 2A has a larger micro hardness, namely larger flexibility, than the non-contact corner 2E, the part that is in contact with the image holding member 12 can easily absorb vibration generated by friction, so that the contact posture of the cleaning blade 220 to the surface of the image holding member 12 readily becomes stable. The non-contact corner 2E has a smaller micro hardness, namely higher hardness, which can also easily make the contact posture of the cleaning blade 220 to the surface of the image holding member 12 stable. Thus, the wear of the cleaning blade 220 is reduced, and the degradation of cleaning performance is therefore readily reduced even after images are repeatedly formed.

In the cleaning blade 220, the ratio ($M_T/M_N$) of the micro hardness at the contact corner 2A ($M_T$) to the micro hardness at the non-contact corner 2E ($M_N$) is preferably from 70/65 to 90/50, and more preferably from 70/60 to 90/55.

At a ratio ($M_T/M_N$) within such a range, the degradation of cleaning performance is readily reduced even after images are repeatedly formed.

The micro hardness at the contact corner 2A and non-contact corner 2E of the cleaning blade 220 refers to hardness measured with a hardness tester MD-1 manufactured by KOBUNSHI KEIKI CO., LTD.

Specifically, a specimen is cut out of a corner that is to be analyzed and used as a sample, and the hardness of the sample is measured with the hardness tester (MD-1 manufactured by KOBUNSHI KEIKI CO., LTD.). In principle, the hardness tester conforms to a type-A durometer defined in JIS K6253-3 (2012), a push needle is pressed against the surface of the sample with a spring to deform the surface, and the measurement is made on the basis of the depth of the pressing of the push needle in a state in which the resistance of the sample and the force of the spring are balanced with each other.

The diameter of the push needle is 0.16 mm, and the push needle is protruding from a pressing surface in 0.5 mm and pressed with the spring at a force of 22 mN in a non-measurement mode (change in the position of the push needle is 0 mm). The micro hardness in this state is defined as 0°. When the depth of the pressing of the push needle is 0 mm (change in the position of the push needle is 0.5 mm), the push needle is pressed with the spring at a force of 330 mN. The micro hardness in this state is defined as 100°. The distance therebetween is calibrated at the equal intervals to define the scale for the measurement of micro hardness. The pressing surface of the hardness tester has an outer diameter of 4 mm and a hole with a diameter of 1.5 mm at the center to pass through the push needle.

The measuring machine having such a structure is used, the push needle is pressed against the sample, and the value in a balanced state is determined to define micro hardness. The relationship between micro hardness Hm (degree) and a load at the point of the push needle F (mN) is defined by the following equation.

$$F=22+3.1Hm$$

Specific examples of the cleaning blade having the difference in micro hardness between the contact corner 2A and the non-contact corner 2E will now be described.

Figure 4:
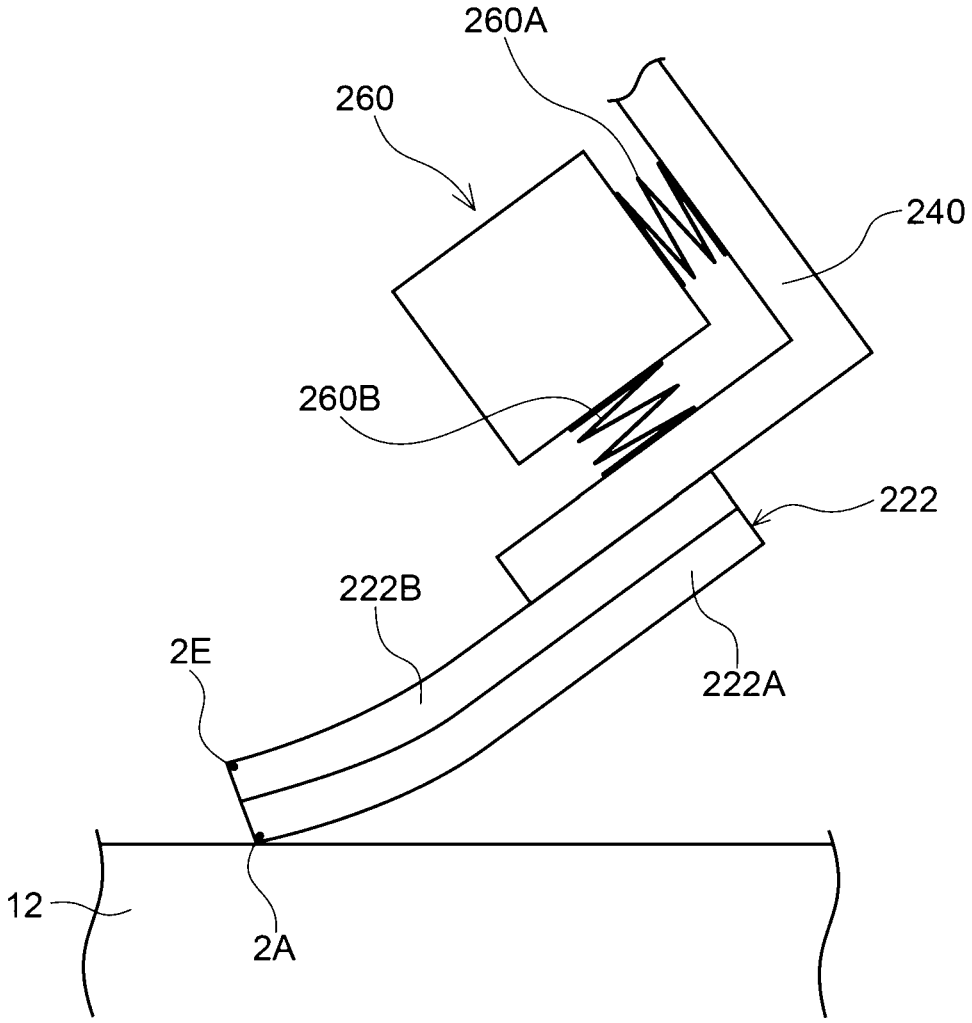
FIG. 4 schematically illustrates another example of the structure of the cleaning device according to the exemplary embodiments in which another type of cleaning blade is used.

A cleaning blade 222 illustrated in FIG. 4, for example has a two-layered structure of a first layer 222A that includes the part being in contact with the image holding member 12 (contact corner 2A) and that is formed so as to serve as the entire under surface 2C and a second layer 222B that is disposed on the back surface 2D side relative to the first layer 222A and that is formed of harder material than the first layer 222A to serve as the back layer.

Figure 5:
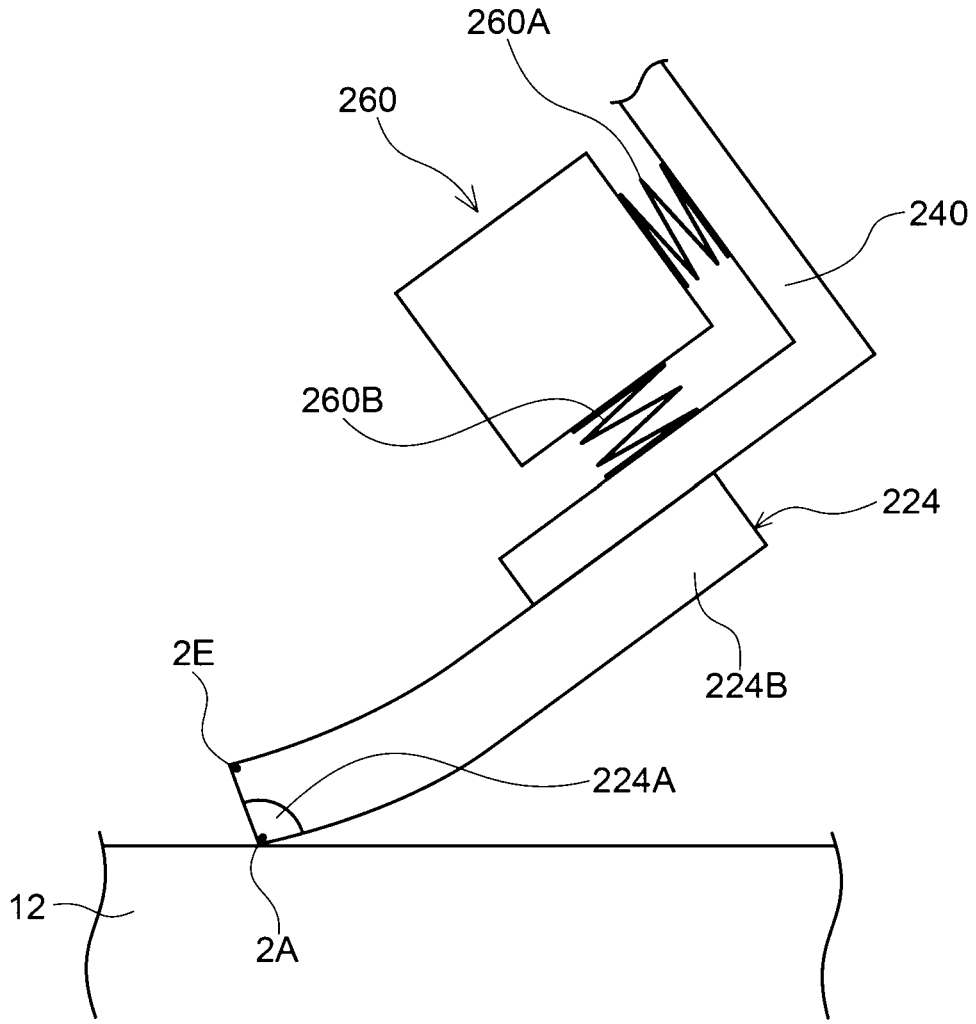
FIG. 5 schematically illustrates another example of the structure of the cleaning device according to the exemplary embodiments in which another type of cleaning blade is used.

A cleaning blade 224 illustrated in FIG. 5 includes a contact member (edge member) 224A and a back member 224B. The contact member 224A includes the part that is in contact with the image holding member 12 (contact corner 2A) and has a shape of a column cut into quarters and extending in the depth direction, and the right-angled part of this structure serves as the contact corner 2A. The back member 224B covers the contact member 224A on the back surface 2D side in the thickness direction of the contact member 224A and on the side opposite to the end surface 2B in the width direction thereof; in other words, it is the part of the cleaning blade 224 other than the contact member 224A. The back member 224B is formed of a harder material than the contact member 224A.

In the example given in FIG. 5, the contact member 224A is a member having a shape of a column cut into quarters but not limited thereto. The contact member 224A may be, for example, a member having a shape of an elliptic pole cut into quarters, and the shape may be a square or a rectangle.

Production of Cleaning Blade

The cleaning blade 220 illustrated in FIG. 2 is, for instance, formed of a single material as follows. In the case where the cleaning blade 220 is formed of a thermoplastic resin, the thermoplastic resin is heated and melted and then injected into a mold having a space corresponding to the shape in FIG. 2 with an injection molding apparatus or another apparatus by extrusion molding. Then, the resulting resin is cooled into a solid and separated from the mold to complete the cleaning blade 220.

The cleaning blade 222 illustrated in FIG. 4, which has multiple layers such as two layers, is produced by attaching the first layer 222A as the contact member to the second layer 222B as the non-contact member (multiple layers in the case where three or more layers are used) to each other. The layers are suitably attached to each other with a double-sided adhesive tape and a variety of adhesives. The multiple layers may be attached to each other as follows: the materials of the individual layers may be separately poured into a mold at a time interval in the formation of the cleaning blade 222, so that the materials of the individual layers adhere to each other without an adhesive layer.

The cleaning blade 224 illustrated in FIG. 5, which has the contact member (edge member) 224A and the non-contact member (back member) 224B, is produced as follows. A first mold having a recess for forming a semi-cylindrical shape (region into which a composition for forming the contact member is poured) that corresponds to the shape of two pieces of the contact member 224A in FIG. 5 combined with each other on the under surface 2C side is prepared. A second mold having a recess for forming the structure of two sets of the contact member 224A and the non-contact member 224B combined with each other on the under surface 2C side is also prepared. A composition for forming the contact member 224A is poured into the recess of the first mold and cured to form a first molded article having a shape corresponding to the shape of two contact members 224A combined with each other. Then, the first mold is removed, and the second mold is placed such that the first molded article is disposed inside the recess of the second mold. A composition for forming the non-contact member 224B is poured into the recess of the second mold to surround the first molded article and then cured to form a second molded article having a shape corresponding to the shape of two sets of the contact member 224A and the non-contact member 224B combined with each other on the under surface 2C side. The second molded article is subsequently cut in half, namely cut along the line that is to serve as the under surface 2C. In particular, the semi-cylindrical contact member is cut in half to have a cylindrical shape cut into quarters. The resulting product is further cut in a predetermined size, thereby completing the cleaning blade 224 in FIG. 5.

In the cleaning blade 222 having two-layered structure in FIG. 4 and the cleaning blade 224 having the contact member 224A and the non-contact member 224B in FIG. 5, the individual members can, for example, have different hardness (micro hardness) by changing materials to be used, changing the degree of polymerization of resins to be used, or adjusting hardness through a hardening treatment.

The adjustment of hardness through a hardening treatment will be specifically described.

An example of the hardening treatment is as follows. The surface of a cleaning blade member is subjected to a plasma treatment to form a coating film with high hardness thereon. An example of such a coating film with high hardness is a coating film of diamond-like carbon (DLC). The coating film is thin with a thickness, for example, ranging from 0.5 μm to 2.0 μm, which gives necessary elasticity to the member.

Image Holding Member

The image holding member 12 has a substrate having a conductivity (for example, volume resistivity at 20° C.: $1\times10^{-6}$ Ωcm or less) and a photosensitive layer formed thereon. The photosensitive layer normally exhibits high resistance (resistance of general resins); in the case where the photosensitive layer is irradiated with light L such as a laser beam, the specific resistance of the irradiated part thereof is changed.

Charging Device

The charging device 15 charges the surface of the image holding member 12. The charging device 15 is, for example, disposed in contact or non-contact with the surface of the image holding member 12 and has a charging member 14 that charges the surface of the image holding member 12 and a power source 28 that applies a charging voltage to the charging device 14. The power source 28 is electrically connected to the charging device 14.

Examples of the charging member 14 of the charging device 15 include contact-type chargers that involve use of a conductive charging roller, charging brush, charging film, charging rubber blade, or charging tube. Other examples of the charging member 14 include known chargers such as a non-contact-type roller charger and a scorotron or coroton charger in which corona discharge is utilized.

Electrostatic Charge Image Forming Device

The electrostatic charge image forming device 16 forms an electrostatic charge image on the charged surface of the image holding member 12. Specifically, for example, the electrostatic charge image forming device 16 radiates modulated light L to the surface of the image holding member 12, which has been charged by the charging member 14, on the basis of the information of an image to be formed, thereby forming an electrostatic charge image on the image holding member 12 on the basis of the information of the intended image.

Examples of the electrostatic charge image forming device 16 include optical systems having a light source that exposes the surface of the image holding member 12 to light, such as light emitted from a semiconductor laser, a light-emitting diode (LED), or a liquid crystal shutter, in the shape of an image Developing Device The developing device 18 is, for example, disposed downstream of the position at which the electrostatic charge image forming device 16 emits light L in the rotational direction of the image holding member 12. Inside the developing device 18, a container that contains a developer is provided. The container has an electrostatic charge image developer containing a specific toner. The toner is, for instance, stored in a state in which it has been charged in the developing device 18.

The developing device 18, for example, includes a developing member 18A that develops the electrostatic charge image on the surface of the image holding member 12 with the developer containing the toner and a power source 32 that applies a developing voltage to the developing member 18A. The developing member 18A is, for instance, electrically connected to the power source 32.

The developing member 18A of the developing device 18 is selected on the basis of the type of the developer, and an example of the developing member 18A is a developing roller that has a developing sleeve having a magnet incorporated thereinto.

The developing device 18 (including power source 32) is, for example, electrically connected to the controller 36 provided in the image forming apparatus 10, and the controller 36 controls the driving of the developing device 18 to apply a developing voltage to the developing member 18A. The developing member 18A subjected to the application of a developing voltage is charged to a developing potential based on the developing voltage. The developing member 18A charged to the developing potential, for instance, holds a developer in the developing device 18 on its surface to supply the toner contained in the developer from the inside of the developing device 18 to the surface of the image holding member 12. On the surface of the image holding member 12 which has received the toner, the electrostatic charge image is developed as a toner image.

Transfer Device

The transfer device 31 is, for example, disposed downstream of the position of the developing member 18A in the rotational direction of the image holding member 12. The transfer device 31, for instance, includes a transfer member 20 that transfers the toner image formed on the surface of the image holding member 12 to the recording medium 30A and a power source 30 that applies a transfer voltage to the transfer member 20. The transfer member 20 is, for example, columnar and nips the recording medium 30A with the image holding member 12 to transport it. The transfer member 20 is, for example, electrically connected to the power source 30.

Examples of the transfer member 20 include contact-type transfer chargers in which a belt, a roller, a film, or a rubber cleaning blade is used and known non-contact-type transfer chargers such as a scorotron or coroton transfer charger in which corona discharge is utilized.

The transfer device 31 (including power source 30) is, for example, electrically connected to the controller 36 provided in the image forming apparatus 10, and the controller 36 controls the driving of the transfer device 31 to apply a transfer voltage to the transfer member 20. The transfer member 20 subjected to the application of a transfer voltage is charged to a transfer potential based on the transfer voltage.

When a transfer voltage is applied to the transfer member 20 by the power source 30 in the opposite polarity to the toner used in the toner image formed on the image holding member 12, a transfer electric field is, for example, formed at the field intensity that enables the toner used in the toner image on the image holding member 12 to be transferred from the image holding member 12 toward the transfer member 20 by an electrostatic force in the region in which the image holding member 12 faces the transfer member 20 (transfer region 32A in FIG. 1)

The recording medium 30A is, for instance, held in a container (not illustrated) and taken out of the container and transported along a transport path 34 by multiple transport members (not illustrated). Then, the recording medium 30A reaches the transfer region 32A that is the region in which the image holding member 12 faces the transfer member 20. In the example in FIG. 1, the recording medium 30A is transported in the direction indicated by the arrow B. The recording medium 30A that has reached the transfer region 32A is, for example, subjected to the transfer of the toner image on the image holding member 12 by a transfer electric field generated in this region through application of the transfer voltage to the transfer member 20. In particular, for instance, the toner moves from the surface of the image holding member 12 to the recording member 30A, so that the toner image is transferred onto the recording medium 30A. The toner image on the image holding member 12 is transferred onto the recording medium 30A by a transfer electric field in this manner.

Erasing Device

The erasing device 24 is, for example, disposed downstream of the cleaning device 22 in the rotational direction of the image holding member 12. The erasing device 24 emits light to the surface of the image holding member 12 to remove electricity after the transfer of the toner image. Specifically, for instance, the erasing device 24 is electrically connected to the controller 36 provided in the image forming apparatus 10, and the controller 36 controls the driving of the erasing device 24 to expose the entire surface of the image holding member 12 (in particular, for example, the entire surface of the image forming area) to light, so that electricity is removed.

Examples of the erasing device 24 include devices having light sources such as a tungsten lamp that emits white light and a light-emitting diode (LED) that emits red light.

Fixing Device

The fixing device 26 is, for example, disposed downstream of the transfer region 32A in the transport direction of the recording medium 30A in the transport path 34. The fixing device 26 includes a fixing member 26A and a pressing member 26B that is disposed in contact with the fixing member 26A. The toner image transferred onto the recording medium 30A is fixed at the contact part at which the fixing member 26A is in contact with the pressing member 26B. Specifically, for instance, the fixing device 26 is electrically connected to the controller 36 provided in the image forming apparatus 10, and the controller 36 controls the driving of the fixing device 26 to fix the toner image, which has been transferred onto the recording medium 30A, to the recording medium 30A by application of heat and pressure.

Examples of the fixing device 26 include known fixing devices such as a heat roller fixing device and an oven fixing device.

Specifically, for instance, the fixing device 26 can be any of known fixing devices in which a fixing roller or a fixing belt is used as the fixing member 26A and in which a pressing roller or a pressing belt is used as the pressing member 26B.

The recording medium 30A that has been transported along the transport path 34 and subjected to the transfer of the toner image by passing through the region in which the image holding member 12 faces the transfer member 20 (transfer region 32A) is, for example, further transported along the transport path 34 by a transporting member (not illustrated) and reaches the position of the fixing device 26, and then the toner image on the recording medium 30A is fixed.

The recording medium 30A having an image completed by the fixing of the toner image is ejected to the outside of the image forming apparatus 10 by multiple transporting members (not illustrated). The image holding member 12 after the removal of electricity by the erasing device 24 is charged again to charge potential by the charging device 15.

Operation of Image Forming Apparatus

An example of the operation of the image forming apparatus 10 according to the exemplary embodiments will now be described. The operation processes in the image forming apparatus 10 are carried out by a control program that the controller 36 executes.

The image forming operation of the image forming apparatus 10 will now be described.

The surface of the image holding member 12 is charged by the charging device 15. The charged surface of the image holding member 12 is exposed to light by the electrostatic charge image forming device 16 on the basis of image information. Then, an electrostatic charge image based on the image information is formed on the image holding member 12. The developing device 18 develops the electrostatic charge image on the surface of the image holding member 12 with a developer containing the specific toner. Through such a process, a toner image is formed on the surface of the image holding member 12.

The transfer device 31 transfers the toner image formed on the surface of the image holding member 12 to the recording medium 30A. The toner image transferred to the recording medium 30A is fixed by the fixing device 26.

The cleaning blade 220 of the cleaning device 22 cleans the surface of the image holding member 12 after the transfer of the toner image. Then, the erasing device 24 removes electricity from the cleaned surface of the image holding member 12.

Electrostatic Charge Image Developer

An electrostatic charge image developer contained in the developing unit of the image forming apparatus of the exemplary embodiments (also referred to as "electrostatic charge image developer used in the exemplary embodiments") will now be described in detail.

The electrostatic charge image developer used in the exemplary embodiments at least contains toner.

The electrostatic charge image developer used in the exemplary embodiments may be a single component developer containing only toner or may be a two-component toner containing toner and a carrier.

Toner

The toner contains toner particles and an external additive.

Toner Particles

The toner particles contain, for example, a binder resin. The toner particles may contain a colorant, a release agent, and another additive.

Binder Resin

The binder resin to be used is an amorphous polyester resin.

The amorphous resin herein does not show a clear endothermic peak but show only a step-like endothermic change in a thermal analysis by differential scanning calorimetry (DSC); in addition, it is a solid at room temperature and thermoplasticized at the glass transition temperature or higher.

In contrast, a crystalline resin does not show a step-like change in the amount of endothermic energy but show a clear endothermic peak in an analysis by differential scanning calorimetry (DSC).

Specifically, for example, the half-value width of the endothermic peak of the crystalline resin is within 10° C. when the analysis is performed at a temperature increase rate of 10° C./min, and the amorphous resin has a half-value width of greater than 10° C. or does not have a clear endothermic peak.

Examples of the amorphous polyester resin include polycondensates of a polycarboxylic acid with a polyhydric alcohol. The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

Alkylene oxide adducts of bisphenol A (such as ethylene oxide adduct of bisphenol A, propylene oxide adduct of bisphenol A, and ethylene oxide-propylene oxide adduct of bisphenol A) are not used as the polyhydric alcohol or used in a slight amount if any. Specifically, in the case where an alkylene oxide adduct of bisphenol A is used, the amount thereof is greater than 0 mol % but not more than 5 mol % relative to the amount of the whole polyhydric alcohol.

The amorphous polyester resin has a glass transition temperature (Tg) ranging preferably from 50° C. to 80° C., and more preferably from 50° C. to 65° C.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The amorphous polyester resin has a weight average molecular weight (Mw) ranging preferably from 5000 to 1000000, more preferably from 7000 to 500000, and further preferably from 30000 to 50000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and the number average molecular weight are determined by gel permeation chromatography (GPC). The determination of the molecular weight by GPC involves using a measurement apparatus that is GPC•HLC-8120GPC manufactured by Tosoh Corporation, a column that is TSK gel Super HM-M (15 cm) manufactured by Tosoh Corporation, and a tetrahydrofuran (THF) solvent. From results of GPC, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used, such monomers are preliminarily subjected to condensation with an acid or alcohol that is to undergo polycondensation with the monomers, and then the resulting product is subjected to polycondensation with the principle components.

The amount of the amorphous polyester resin is preferably from 60 mass % to 98 mass %, more preferably from 70 mass % to 98 mass %, and further preferably 80 mass % to 98 mass % relative to the amount of the whole binder resin.

The amorphous polyester resin may be used in combination with a crystalline resin. The combined use of a crystalline resin enables the moisture absorption of the toner particles to be lowered, so that the degradation of cleaning performance is likely to be reduced even after images are repeatedly formed. The amount of a crystalline polyester resin to be used may be in the range of 2 mass % to 40 mass % (suitably 2 mass % to 20 mass %) relative to the amount of the whole binder resin.

Examples of the crystalline resin include known crystalline resins such as crystalline polyester resins and crystalline vinyl resins (such as polyalkylene resin and long-chain alkyl(meth)acrylate resin). Among these, crystalline polyester resins are suitable in view of reducing the degradation of cleaning performance even after images are repeatedly formed.

Examples of the crystalline polyester resin include polycondensates of a polycarboxylic acid with a polyol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mol % or more, and suitably 90 mol % or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak Temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in production of the amorphous polyester resin.

The amount of the crystalline resin (suitably crystalline polyester resin) is preferably from 3 mass % to 20 mass %, and more preferably from 5 mass % to 15 mass % relative to the amount of the whole toner. The amount of the crystalline resin in such a range enables the degradation of cleaning performance to be easily reduced even after images are repeatedly formed.

Another binder resin different from the amorphous polyester resin and the crystalline resin may be used in combination as the binder resin. The amount of such another resin is suitably 10 mass % or less relative to the amount of the whole binder resin.

Examples of such another binder resin include vinyl resins that are homopolymers of monomers such as styrenes (such as styrene, p-chlorostyrene, and a-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

Other examples of such another binder resin include non-vinyl resins such as epoxy resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins.

The amount of the binder resin is, for instance, preferably from 40 mass % to 95 mass %, more preferably from 50 mass % to 90 mass %, and further preferably from 60 mass % to 85 mass % relative to the amount of the whole toner particles.

Colorant

Examples of the colorant include a variety of pigments, such as carbon black, chrome yellow, Hansa Yellow, benzidine yellow, indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, and malachite green oxalate, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination.

The colorant may be optionally a surface-treated colorant or may be used in combination with a dispersant. Different types of colorants may be used in combination.

The amount of the colorant is, for instance, preferably from 1 mass % to 30 mass %, and more preferably from 3 mass % to 15 mass % relative to the amount of the whole toner particles.

Release Agent

Examples of a release gent include, but are not limited to, hydrocarbon waxes; natural waxes such as a carnauba wax, a rice bran wax, and a candelilla wax; synthetic or mineral/petroleum waxes such as a montan wax; and ester waxes such as a fatty acid ester and a montanic acid ester.

The melting temperature of the release agent is preferably from 50° C. to 110° C., and more preferably from 60° C. to 100° C.

The melting temperature is determined from a DSC curve obtained by differential scanning calorimetry (DSC) in accordance with "Melting Peak Temperature" described in determination of melting temperature in JIS K 7121-1987 "Testing Methods for Transition Temperatures of Plastics".

The amount of the release agent is, for example, preferably from 1 mass % to 20 mass %, and more preferably from 5 mass % to 15 mass % relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

In the case where the toner particles are analyzed by infrared absorption spectrometry, the ratio of absorbance for a wavenumber of 1500 $cm^{-1}$ to absorbance for a wavenumber of 720 $cm^{-1}$ is 0.6 or less (preferably 0.5 or less, and more preferably 0.48 or less), and the ratio of absorbance for a wavenumber of 820 $cm^{-1}$ to absorbance for a wavenumber of 720 $cm^{-1}$ is 0.4 or less (preferably 0.3 or less, and more preferably 0.2 or less).

The toner particles exhibit such infrared absorption spectrum characteristics when the polyhydric alcohol component contained in the amorphous polyester resin as the binder resin does not contain an alkylene oxide adduct of bisphenol A or contain it in a slight amount if any as described above.

In the analysis of the toner particles by infrared absorption spectrometry, the ratio of absorbance for a wavenumber of 1500 $cm^{-1}$ to absorbance for a wavenumber of 720 $cm^{-1}$ may be 0.2 or more (suitably 0.3 or more), and the ratio of absorbance for a wavenumber of 820 $cm^{-1}$ to absorbance for a wavenumber of 720 $cm^{-1}$ is 0.05 or more (suitably 0.08 or more) in terms of the storage stability of the toner.

In the analysis of the toner particles by infrared absorption spectrometry, the ratio of absorbance for a wavenumber of 820 $cm^{-1}$ to absorbance for a wavenumber of 1500 $cm^{-1}$ may be 0.5 or less (preferably 0.4 or less, and more preferably 0.35 or less) in terms of the strength of the toner particles.

In the analysis of the toner particles by infrared absorption spectrometry, the ratio of absorbance for a wavenumber of 820 $cm^{-1}$ to absorbance for a wavenumber of 1500 $cm^{-1}$ may be 0.1 or more (suitably 0.15 or more) in terms of the storage stability of the toner.

The absorbance for the individual wavenumbers is measured by infrared absorption spectrometry as follows. Toner particles (or toner) that are to be analyzed are formed into a test sample by a KBr pellet technique. The test sample is analyzed in the wavenumber range of 500 $cm^{-1}$ to 4000 $cm^{-1}$ with an infrared spectrophotometer (FT-IR-410 manufactured by JASCO Corporation) at number of integration of 300 times and resolution of 4 $cm^{-1}$. Baseline correction is carried out at, for instance, an offset part having no light absorption to determine the absorbance for the individual wavenumbers.

In the case where the THF-soluble component of the toner particles is subjected to a GPC analysis to determine a weight average molecular weight Mw and a number average molecular weight Mn, Mw is from 25,000 to 60,000 (preferably from 30000 to 50000, and more preferably from 32000 to 48000), and Mw/Mn is from 5 to 10 (preferably from 6 to 8, and more preferably from 6.2 to 7.8).

Such molecular weight characteristics of the toner particles enable an enhancement in the fixability of a fixed image even in the case of using the toner of which the toner particles contain the amorphous polyester resin in which an alkylene oxide adduct of bisphenol A is not used or used in a slight amount as described above.

The peak molecular weight in the molecular weight distribution curve obtained by the GPC analysis of the THF-soluble component of the toner particles is preferably from 7,000 to 11,000, more preferably from 8,000 to 11,000, and further preferably from 8,200 to 10,500.

At a peak molecular weight in such a range, the fixability of a fixed image can be easily enhanced even in the case of using the toner of which the toner particles contain the amorphous polyester resin in which an alkylene oxide adduct of bisphenol A is not used or used in a slight amount.

In the case where a molecular weight distribution curve obtained by the GPC analysis of the THF-soluble component of the toner particles has multiple peaks, the term "peak molecular weight" refers to the molecular weight at the highest peak.

In the GPC analysis of the THF-soluble component of the toner particles, the molecular weight distribution curve, the average molecular weights, and the peak molecular weight are determined as follows.

Into 1 g of tetrahydrofuran (THF), 0.5 mg of toner particles (or toner) that are to be analyzed are dissolved. The solution is subjected to ultrasonic dispersion, the concentration of the toner particles is adjusted to be 0.5%, and then the dissolved component thereof is analyzed by GPC.

A GPC apparatus to be used is "HLC-8120GPC, SC-8020 (manufactured by Tosoh Corporation)", two columns of "TSKgel, SUPERHM-H (manufactured by Tosoh Corporation, 6.0 mm ID×15 cm)" are used, and THF is used as an eluent. The concentration of the sample is 0.5%, the flow rate is 0.6 ml/min, the injection amount of the sample is 10 μl, the measurement temperature is 40° C., and a refractive index (RI) detector is used. The calibration curve is determined from 10 samples of "polystyrene standard sample of TSK standard" manufactured by Tosoh Corporation: "A-500", "F-1", "F-10", "F-80", "F-380", "A-2500", "F-4", "F-40", "F-128", and "F-700".

The amount of the toluene-insoluble component of the toner particles is preferably from 25 mass % to 45 mass %, more preferably from 28 mass % to 38 mass %, and further preferably from 30 mass % to 35 mass %.

At an amount of the toluene-insoluble component of the toner particles in such a range, the moisture absorption of the toner particles is lowered, which enables the degradation of cleaning performance to be easily reduced even after images are repeatedly formed.

The toluene-insoluble component of the toner particles refers to the component that is contained in the toner particles but not dissolved in toluene. In other words, the toluene-insoluble component is an insoluble matter of which the principle component (for instance, 50 mass % or more of the whole) is a component of the binder resin that is not dissolved in toluene (particularly high-molecular-weight component of binder resin). The amount of the toluene-insoluble component can be an index of the cross-linked resin content in the toner.

The amount of the toluene-insoluble component is measured as follows.

Toner particles (or toner) weighed to 1 g are put into weighed cylindrical filter paper made of glass fibers, and this cylindrical filter paper is attached to the extraction tube of a thermal Soxhlet extractor. Toluene is put into a flask and heated to 110° C. with a mantle heater. A heater attached to the extraction tube is used to heat the surrounding of the extraction tube to 125° C. The extraction is performed at such a reflux rate that a single cycle of extraction is in the range of four minutes to five minutes. After the extraction is performed for 10 hours, the cylindrical paper filter and residual toner are retrieved, dried, and weighed.

Then, the amount (mass %) of the toner particle residue (or toner residue) is calculated on the basis of the following equation and defined as the amount of the toluene-insoluble component (mass %).

amount (mass %) of toner particle residue (or toner residue)=[(weight of cylindrical filter paper+weight of residual toner) (g)−weight of cylindrical filter paper (g)]+mass (g) of toner particles (or toner)×100 Equation:

The toner particle residue (or toner residue) contains, for example, a colorant, an inorganic substance such as an external additive, and the high-molecular-weight component of the binder resin. In the case where toner particles contain a release agent, the release agent is a toluene-soluble component because the extraction is carried out through heating.

The toluene-insoluble component of the toner particles is, for example, adjusted by (1) adding a cross-linking agent to a high-molecular-weight component having a reactive functional group at its end to form a cross-linked structure or a branched structure in the binder resin, (2) using a polyvalent metal ion in the binder resin to form a cross-linked structure or a branched structure in a high-molecular-weight component having an ionic functional group at its end, or (3) using, for instance, isocyanate in the binder resin to extend the chain structure of the resin or to allow it to branch.

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50v) of the toner particles is preferably from 2 μm to 10 μm, and more preferably from 4 μm to 8 μm.

The average particle size of the toner particles and the index of the particle size distribution thereof are measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of an aqueous solution of a 5% surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size D16v and a number particle size D16p, while the particle size for a cumulative percentage of 50% is defined as a volume average particle size D50v and a number average particle size D50p. Furthermore, the particle size for a cumulative percentage of 84% is defined as a volume particle size D84v and a number particle size D84p.

From these particle sizes, the index of the volume particle size distribution (GSDv) is calculated as $(D84v/D16v)^{1/2}$, while the index of the number particle size distribution (GSDp) is calculated as $(D84p/D16p)^{1/2}$.

The average circularity of the toner particles is preferably from 0.94 to 1.00, and more preferably from 0.95 to 0.98.

The average circularity of the toner particles is determined from (circle-equivalent circumference)/(circumference) [circumference of circle having the same projection area as image of particle]/(circumference of projection image of particle)]. In particular, the average circularity of the toner particles is determined as follows.

The toner particles that are to be analyzed are collected by being sucked and allowed to flow in a flat stream. An image of the particles is taken as a still image by instant emission of stroboscopic light and then analyzed with a flow particle image analyzer (FPIA-3000 manufactured by SYSMEX CORPORATION). The number of samples used to determine the average circularity is 3500.

In the case where the toner contains an external additive, the toner (developer) to be analyzed is dispersed in water containing a surfactant and then subjected to an ultrasonic treatment to obtain toner particles having no external additive content.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O\cdot(TiO_2)_n$, $Al_2O_3.2SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high-molecular-weight fluorine material).

The amount of the external additive to be used is, for example, preferably from 0.01 mass % to 5 mass %, and more preferably from 0.01 mass % to 2.0 mass % relative to the amount of the toner particles.

Production of Toner

Production of the toner used in the exemplary embodiments will now be described.

The toner used in the exemplary embodiments can be produced by preparing toner particles and then externally adding an external additive to the toner particles.

The toner particles may be produced by any of a dry process (such as kneading pulverizing method) and a wet process (such as aggregation coalescence method, suspension polymerization method, or dissolution suspension method). Production of the toner particles is not particularly limited to these production processes, and any of known techniques can be employed.

The toner used in the exemplary embodiments is produced, for example, by adding an external additive to the produced toner particles being in a dried state and then mixing them with each other. The mixing may be carried out, for instance, with a V blender, a HENSCHEL MIXER, or a Loedige mixer. Furthermore, a vibratory sieving machine or a wind sieving machine may be optionally used to remove the coarse particles of the toner.

Carrier

A carrier is not particularly limited, and any of known carriers can be used. Examples of the carrier include coated carriers in which the surface of a core formed of magnetic powder have been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably from 1:100 to 30:100, and more preferably from 3:100 to 20:100.

The structure of the image forming apparatus described in the exemplary embodiments is merely an example and may be changed without departing from the scope of the exemplary embodiments.

EXAMPLES

The exemplary embodiments of the invention will now be further specifically described in detail with reference to Examples and Comparative Examples but are not limited thereto at all.

Preparation of Amorphous Polyester Resin

Preparation of Amorphous Polyester Resin (A1)

Into a three-neck flask of which the inside has been dried, 60 parts by mass of dimethyl terephthalate, 74 parts by mass of dimethyl fumarate, 30 parts by mass of dodecenylsuccinic anhydride, 22 parts by mass of trimellitic acid, 138 parts by mass of propylene glycol, and 0.3 parts by mass of dibutyltin oxide are put. The mixture is reacted at 185° C. for 3 hours under nitrogen atmosphere while removing water generated during the reaction to the outside. Then, the temperature is increased up to 240° C. while the pressure is gradually reduced, and the resulting product is further reacted for 4 hours and then cooled. Through this process, an amorphous polyester resin (A1) having a weight average molecular weight of 39,000 is prepared.

Preparation of Amorphous Polyester Resin (A2)

An amorphous resin (A2) is prepared in the same manner as in the preparation of the amorphous resin (A1) except for the following changes: the reaction is performed at 190° C. for 3 hours, the temperature is subsequently increased up to 220° C. while the pressure is gradually reduced, and the resulting product is further reacted for 2.5 hours. The weight average molecular weight of the amorphous polyester resin (A2) is 26,000.

Preparation of Amorphous Polyester Resin (A3)

An amorphous resin (A3) is prepared in the same manner as in the preparation of the amorphous resin (A1) except for the following changes: 138 parts by mass of the propylene glycol is changed to 128 parts by mass of propylene glycol and 19 parts by mass of butylene glycol, the reaction is performed at 195° C. for 4 hours, the temperature is subsequently increased up to 240° C. while the pressure is gradually reduced, and the resulting product is further reacted for 6 hours. The weight average molecular weight of the amorphous polyester resin (A3) is 56,000.

Preparation of Crystalline Resin

Preparation of Crystalline Polyester Resin (B1)

Into a three-neck flask, 100 parts by mass of dimethyl sebacate, 67.8 parts by mass of hexanediol, and 0.10 parts by mass of dibutyltin oxide are put. The mixture is reacted at 185° C. for 5 hours under nitrogen atmosphere while removing water generated in the reaction to the outside. Then, the temperature is increased up to 220° C. while the pressure is gradually reduced, and the resulting product is further reacted for 6 hours and then cooled. Through this process, a crystalline polyester resin (B1) having a weight average molecular weight of 33,700 is prepared.

The melting temperature of the crystalline polyester resin (B1) is determined from a DSC curve obtained by differential scanning calorimetry (DSC) in accordance with "Melting Peak Temperature" described in determination of melting temperature in JIS K 7121-1987 "Testing Methods for Transition Temperatures of Plastics". The melting temperature is 71° C.

Preparation of Referential Amorphous Polyester Resin

Preparation of Referential Amorphous Polyester Resin (C1)

An amorphous resin (C1) is prepared in the same manner as in the preparation of the amorphous resin (A1) except that the composition of the components is changed to 60 parts by mass of dimethyl terephthalate, 74 parts by mass of dimethyl fumarate, 30 parts by mass of dodecenylsuccinic anhydride, 22 parts by mass of trimellitic acid, 137 parts by mass of an ethylene oxide adduct of bisphenol A, 191 parts by mass of a propylene oxide adduct of bisphenol A, and 0.3 parts by mass of dibutyltin oxide. The weight average molecular weight of the referential amorphous polyester resin (C1) is 27,000.

Production of Toner

Production of Toner (1)

Into a HENSCHEL MIXER (manufactured by NIPPON COKE & ENGINEERING CO., LTD.), 73 parts by mass of the amorphous polyester resin (A1), 6 parts by mass of the crystalline polyester resin (B1), 7 parts by mass of a colorant (C.I. Pigment Red 122), 5 parts by mass of a release agent (paraffin wax manufactured by NIPPON SEIRO CO., LTD., melting temperature of 73° C.), and 2 parts by mass of ester wax (behenyl behenate, UNISTER M-2222SL manufactured by NOF CORPORATION) are put. The mixture is stirred and mixed at a rotational speed of 15 m/s for 5 minutes, and the resulting mixture is melt-kneaded with an extruder-type continuous kneader.

In the extruder-type continuous kneader, the temperature is 160° C. on the supply side and 130° C. on the discharge side, the temperature of a cooling roller is 40° C. on the supply side and 25° C. on the discharge side. The temperature of a cooling belt is adjusted to be 10° C.

The melt-kneaded product is cooled, then roughly pulverized with a hammer mill, and subsequently finely pulverized with a jet-type pulverizer (manufactured by Nippon Pneumatic Mfg. Co., Ltd.) to 6.5 μm. The resulting product is classified with an elbow-jet classifier (type: EJ-LABO, manufactured by Nittetsu Mining Co., Ltd.) to yield toner particles (1). The toner particles (1) have a volume average particle size of 7.0 μm.

Then, 100 parts by mass of the toner particles (1) and 1.2 parts by mass of an external additive that is a commercially available fumed silica RX50 (manufactured by NIPPON AEROSIL CO., LTD.) are mixed with each other with a HENSHEL MIXER (manufactured by MITSUI MIIKE MACHINERY Co., Ltd.) at a rotational speed of 30 m/s for 5 minutes, thereby obtaining toner (1).

Production of Toner (2)

Toner particles (2) are prepared in the same manner as in the preparation of the toner particles (1) except that the amorphous polyester resin (A2) is used in place of the amorphous polyester resin (A1). The toner particles (2) have a volume average particle size of 6.8 μm.

Except that the toner particles (2) replace the toner particles (1), toner (2) is produced as in the production of the toner (1).

Production of Toner (3)

Toner particles (3) are prepared in the same manner as in the preparation of the toner particles (1) except that the amorphous polyester resin (A3) is used in place of the amorphous polyester resin (A1). The toner particles (3) have a volume average particle size of 7.5 μm.

Except that the toner particles (3) replace the toner particles (1), toner (3) is produced as in the production of the toner (1).

Production of Toner (4)

Toner particles (4) are prepared in the same manner as in the preparation of the toner particles (1) except that the amount of the amorphous polyester resin (A1) is changed to 79 parts by mass and that the crystalline polyester resin (B1) is not used. The toner particles (4) have a volume average particle size of 7.1 μm.

Except that the toner particles (4) replace the toner particles (1), toner (4) is produced as in the production of the toner (1).

Production of Referential Toner (C1)

Referential toner particles (C1) are prepared in the same manner as in the preparation of the toner particles (4) except that the referential amorphous polyester resin (C1) is used in place of the amorphous polyester resin (A1). The referential toner particles (C1) have a volume average particle size of 7.7 μm.

Except that the referential toner particles (C1) replace the toner particles (1), referential toner (C1) is produced as in the production of the toner (1).

Production of Developer

Developers (1) to (4) and Referential Developer (C1)

With 100 parts by mass of a carrier, 8 parts by mass of the individual toners are separately mixed to produce developers (1) to (4) and a referential developer (C1).

In order to produce the carrier, 14 parts by mass of toluene and 2 parts by mass of a styrene-methyl methacrylate copolymer (component ratio: styrene/methyl methacrylate=90/10, weight average molecular weight Mw: 80,000) are stirred for 10 minutes with a stirrer to prepare a coating liquid in which these materials have been dispersed. The coating liquid and 100 parts by mass of ferrite particles (volume average particle size: 50 μm) are put into a vacuum degassing kneader (manufactured by INOUE MFG., INC.) and stirred at 60° C. for 30 minutes. Then, the pressure is reduced for degassing under heating to dry the resulting product, and the dried product is filtered with a 105-μm sieve to yield the carrier.

Analyses

Each of the toners is subjected to analysis of the molecular weight characteristics of the toner particles, analysis of the infrared absorption spectrum characteristics of the toner particles, and analysis of the toluene-insoluble component in the manners described above. Table 1 shows results of the analyses.

Preparation of Cleaning Blade

Cleaning Blade (1)

A plate formed of polyurethane and having a micro hardness of 75°, a size of 347 mm×10 mm×2 mm (thickness), and a single-layer structure is used as a cleaning blade (1).

The ratio ($M_T/M_N$) of the micro hardness at the contact corner 2A ($M_T$) to the micro hardness at the non-contact corner 2E ($M_N$) is 1/1.

Cleaning Blade (2)

A cleaning blade (2) having a plate (first layer as the contact member) and another plate (second layer as the non-contact member) adhering to each other is prepared; in particular, the cleaning blade (2) has the same structure as the cleaning blade 222 illustrated in FIG. 4 and having a two-layered structure, the first layer is formed of polyurethane and has a micro hardness of 75° and a size of 347 mm×10 mm×1 mm (thickness), and the second layer is formed of polyurethane that has a different composition from the polyurethane used in the first layer and that contains an increased amount of a crosslinking component to harden the second layer and has a micro hardness of 42° and a size of 347 mm×10 mm×1 mm (thickness).

The two layers are attached to each other by pouring the materials of the individual layers into a mold at a time interval in formation of the cleaning blade, so that the materials of the individual layers adhere to each other without an adhesive layer.

The ratio ($M_T/M_N$) of the micro hardness at the contact corner 2A ($M_T$) to the micro hardness at the non-contact corner 2E ($M_N$) is 1.8/1.

Examples 1 to 4

Preparation of Image Forming Apparatus (1)

Figure 3:
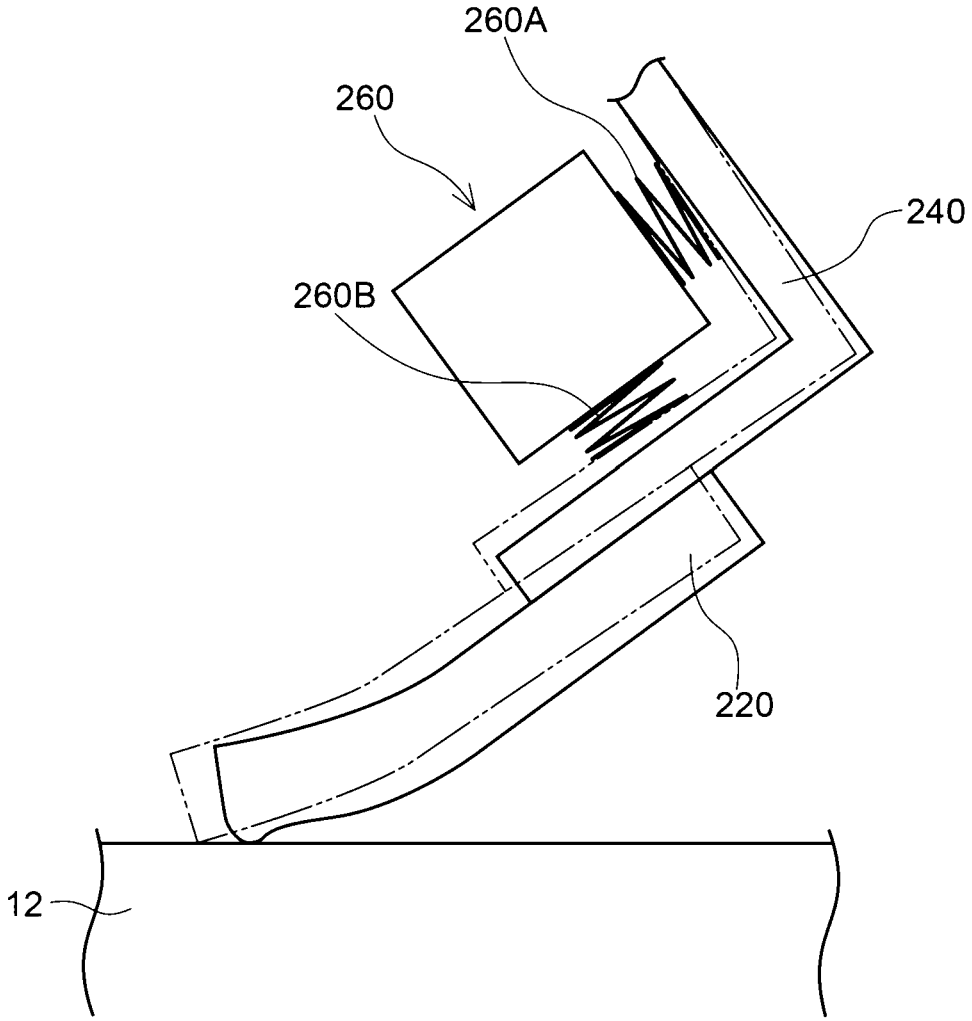
FIG. 3 schematically illustrates the vibration of a cleaning blade and supporting member in the cleaning device according to the exemplary embodiments.

An image forming apparatus (modified machine of APEOSPORT-V C2275 manufactured by Fuji Xerox Co., Ltd.) is prepared, and a cleaning device is changed to the cleaning device having the structure illustrated in FIGS. 2 and 3. In particular, the cleaning device has the cleaning blade 220 having the contact corner 2A that is in contact with the image holding member 12 to clean the image holding member 12 [namely, cleaning blade (1)]; the supporting member 240 which supports the back surface 2D of the cleaning blade 220 on the side opposite to the end being in contact with the image holding member 12, which is disposed so as to be movable in the direction in which the vibration of the cleaning blade 220 sliding on the image holding member 12 is absorbed, and which is formed of aluminum and L-shaped; and the pressing member 260 having springs as the elastic members 260A and 260B which are pressed against the supporting member 240 to press the supporting member 240 so that the cleaning blade 220 is pressed against the image holding member 12 in the direction in which the supporting member 240 can move.

The pressing pressure NF between the cleaning blade and the image holding member is 4.0 gf/mm, the entry amount d is 1.3 mm, and a contact angle θ is 23°. This image forming apparatus (1) is used.

Developers containing the toners (1) to (4) shown in Table 1 are individually put into the developing device of the image forming apparatus (1).

Examples 5 to 8

Preparation of Image Forming Apparatus (2)

Except that the cleaning blade used in the image forming apparatus (1) is changed to the cleaning blade (2), an image forming apparatus (2) having the same structure as the image forming apparatus (1) is prepared.

Developers containing the toners (1) to (4) shown in Table 1 are individually put into the developing device of the image forming apparatus (2).

Comparative Examples 1 to 4 and Reference Example

Preparation of Comparative Image Forming Apparatus (C1)

Figure 6:
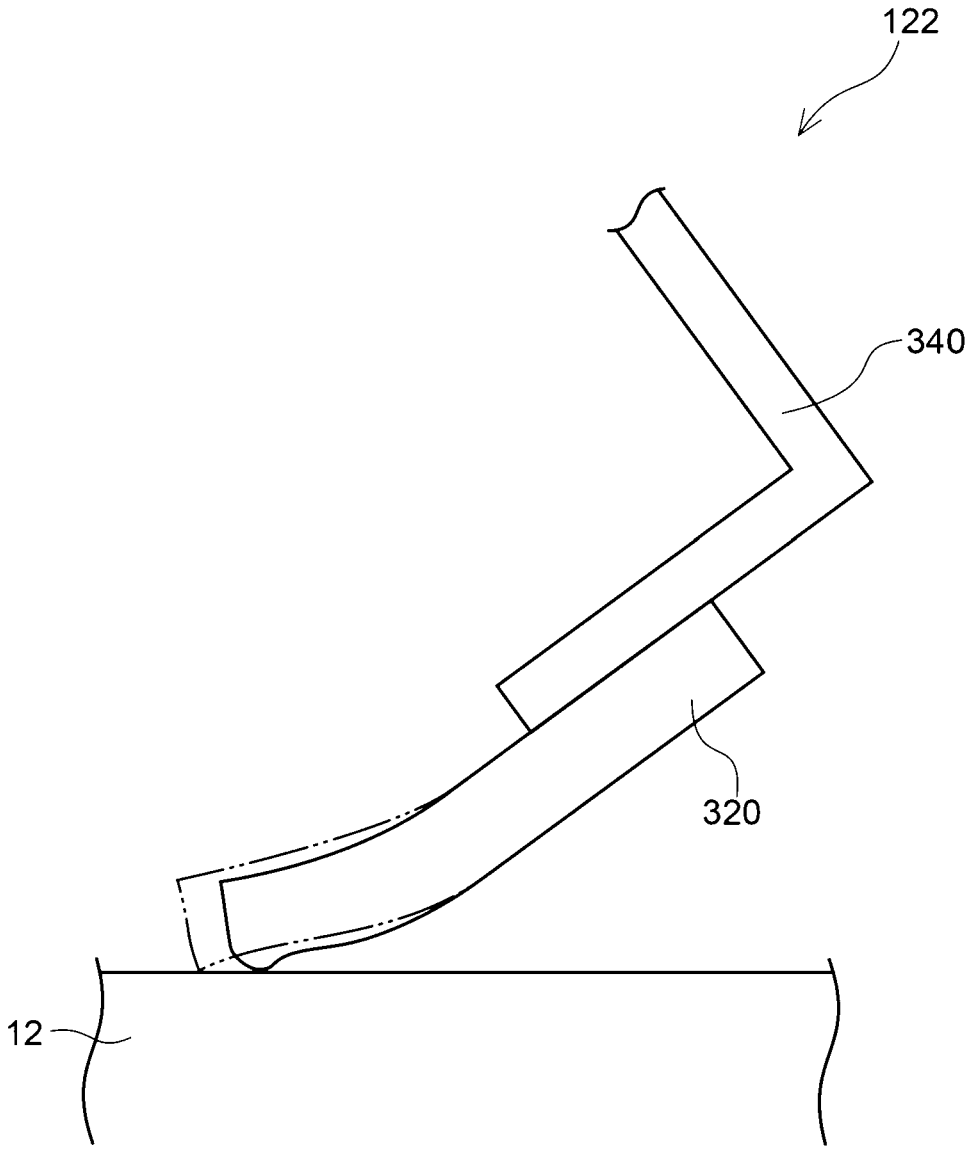
FIG. 6 schematically illustrates the vibration of a cleaning blade in a typical cleaning device.

An image forming apparatus (modified machine of APEOSPORT-V C2275 manufactured by Fuji Xerox Co., Ltd.) is prepared, and a cleaning device is changed to the cleaning device having the structure illustrated in FIG. 6. In particular, the cleaning device has the cleaning blade 320 having the contact corner 2A that is in contact with the image holding member 12 to clean the image holding member 12 [namely, cleaning blade (1)]; the supporting member 340 which supports the back surface 2D of the cleaning blade 320 on the side opposite to the end being in contact with the image holding member 12, which is disposed so as to be fixed (immovable), and which is formed of aluminum and L-shaped; and no pressing member.

The pressing pressure NF between the cleaning blade and the image holding member, the entry amount d, and a contact angle θ are the same as those in the image forming apparatus (1). This image forming apparatus (C1) is used.

Developers containing the toners (1) to (4) and (C1) shown in Table 1 are individually put into the developing device of the image forming apparatus (C1).

Slide Test

The cleaning device of each of the image forming apparatuses (1), (2), and (C1) is subjected to the slide test under the above-mentioned conditions. Loads applied by the cleaning blade to the image holding member are measured in the manner described above before and after the slide test, and the difference in a load between before and after the slide test is determined. Table 2 shows results of the test.

Evaluation

Cleaning Performance after Repeated Formation of Images

The above-mentioned image forming apparatuses are used to evaluate cleaning performance after images are repeatedly formed in the following manner in a high temperature and high humidity environment (temperature of 28° C. and humidity of 85%).

A4 paper (C2 paper manufactured by Fuji Xerox Co., Ltd.) is used to form a half tone image on the entire surface of the paper at an image density of 40%.

The evaluation criteria are as follows.

A: Streaks due to defective cleaning are not observed

B: Streaks due to defective cleaning are observed on the image holding member, but image quality is acceptable C: Streaks due to defective cleaning are observed on the formed image, but image quality is acceptable D: Streaks due to defective cleaning are observed on the formed image, and image quality is unacceptable

TABLE 1

| | Developer (toner) | | | | | | | | | | | | |
|---|---|---|---|---|---|---|---|---|---|---|---|---|---|
| | | | Molecular weight characteristics of toner particles | | | | Infrared absorption spectrum characteristics of toner particles | | | | | | Toluene-insoluble component of toner particles (mass %) |
| | Type | Binder Resin | Mw | Mn | Mw/Mn | Peak molecular weight | Absorbance A for wavenumber of 1500 $cm^{-1}$ | Absorbance B for wavenumber of 820 $cm^{-1}$ | Absorbance C for wavenumber of 720 $cm^{-1}$ | A/C | B/C | B/A | |
| Example 1 | (1) | (A1) + (B1) | 37000 | 5000 | 7.4 | 9500 | 0.07 | 0.02 | 0.15 | 0.5 | 0.1 | 0.3 | 34 |
| Example 2 | (2) | (A2) + (B1) | 25000 | 3000 | 8.3 | 7000 | 0.12 | 0.04 | 0.20 | 0.6 | 0.2 | 0.3 | 28 |
| Example 3 | (3) | (A3) + (B1) | 60000 | 8500 | 7.1 | 11000 | 0.05 | 0.02 | 0.11 | 0.5 | 0.2 | 0.4 | 38 |
| Example 4 | (4) | (A1) | 39000 | 4500 | 8.7 | 9800 | 0.08 | 0.02 | 0.14 | 0.6 | 0.1 | 0.3 | 33 |
| Example 5 | (1) | (A1) + (B1) | 37000 | 5000 | 7.4 | 9500 | 0.07 | 0.02 | 0.15 | 0.5 | 0.1 | 0.3 | 34 |
| Example 6 | (2) | (A2) + (B1) | 25000 | 3000 | 8.3 | 7000 | 0.12 | 0.04 | 0.20 | 0.6 | 0.2 | 0.3 | 28 |
| Example 7 | (3) | (A3) + (B1) | 60000 | 8500 | 7.1 | 11000 | 0.05 | 0.02 | 0.11 | 0.5 | 0.2 | 0.4 | 38 |
| Example 8 | (4) | (A1) | 39000 | 4500 | 8.7 | 9800 | 0.08 | 0.02 | 0.14 | 0.6 | 0.1 | 0.3 | 33 |
| Comparative Example 1 | (1) | (A1) + (B1) | 37000 | 5000 | 7.4 | 9500 | 0.07 | 0.02 | 0.15 | 0.5 | 0.1 | 0.3 | 34 |
| Comparative Example 2 | (2) | (A2) + (B1) | 25000 | 3000 | 8.3 | 7000 | 0.12 | 0.04 | 0.20 | 0.6 | 0.2 | 0.3 | 28 |
| Comparative Example 3 | (3) | (A3) + (B1) | 60000 | 8500 | 7.1 | 11000 | 0.05 | 0.02 | 0.11 | 0.5 | 0.2 | 0.4 | 38 |
| Comparative Example 4 | (4) | (A1) | 39000 | 4500 | 8.7 | 9800 | 0.08 | 0.02 | 0.14 | 0.6 | 0.1 | 0.3 | 33 |
| Reference Example | (C1) | (C1) | 27000 | 5000 | 5.4 | 7500 | 0.90 | 0.50 | 0.30 | 3.00 | 1.67 | 0.56 | 31 |

TABLE 2

| | | Cleaning Device | | | | | | | Evaluation |
|---|---|---|---|---|---|---|---|---|---|
| | | | | | | Cleaning blade | | Load difference between before and afer slide test [gf/mm] | |
| | | Developer Type | Type | Supporting member | Pressing member | Structure | Ratio [$M_T/M_N$] | | Cleaning performance |
| Examples | 1 | (1) | (1) | Movable | Provided | Single-layer structure | 1/1 | 1.2 | A |
| | 2 | (2) | | | | | | | B |
| | 3 | (3) | | | | | | | A |
| | 4 | (4) | | | | | | | A |
| | 5 | (1) | (2) | | | Two-layer structure | 1.8/1 | 1.4 | A |
| | 6 | (2) | | | | | | | B |
| | 7 | (3) | | | | | | | A |
| | 8 | (4) | | | | | | | A |
| Comparative Examples | 1 | (1) | (C1) | Immovable | None | Single-layer structure | 1/1 | 1.6 | D |
| | 2 | (2) | | | | | | | D |
| | 3 | (3) | | | | | | | D |
| | 4 | (4) | | | | | | | D |
| Reference Example | | (C1) | (C1) | Immovable | None | Single-layer structure | 1/1 | 1.6 | B |

As is obvious from the results shown in the table, cleaning performance after repeated formation of images is better in the image forming apparatuses of Examples than in the image forming apparatuses of Comparative Examples. In the image forming apparatuses of Examples, the specific toner is used, the supporting member is disposed so as to be movable in the direction in which the vibration of the cleaning blade that slides on the image holding member is absorbed, the pressing member has the elastic members that are pressed against the supporting member to press the supporting member so that the cleaning blade is pressed against the image holding member in the direction in which the supporting member can move, and the difference in a load applied by the cleaning blade to the image holding member between before and after the slide test is 1.5 gf/mm or less. In the image forming apparatuses of Comparative Examples, the supporting member is fixed, namely immovable, and the difference in a load applied by the cleaning blade to the image holding member between before and after the slide test is more than 1.5 gf/mm.

The image forming apparatus of Reference Example is an example using toner which contains an amorphous polyester resin in which an alkylene oxide adduct of bisphenol A is used. In the image forming apparatus of Reference Example, the degradation of cleaning performance after repeated formation of images is reduced even though the supporting member is fixed, namely immovable, and the difference in a load applied by the cleaning blade to the image holding member between before and after the slide test is more than 1.5 gf/mm.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic charge image forming unit that forms an electrostatic charge image on the charged surface of the image holding member;

a developing unit that has an electrostatic charge image developer and that develops the electrostatic charge image on the surface of the image holding member with the electrostatic charge image developer to form a toner image;

a transfer unit that transfers the toner image formed on the surface of the image holding member to the surface of a recording medium; and a cleaning unit having a cleaning blade that is in contact with the surface of the image holding member to clean the surface of the image holding member, wherein:

the electrostatic charge image developer contains toner, the toner contains an amorphous polyester resin as a binder resin;

a tetrahydrofuran-soluble component of the toner particles has a weight average molecular weight Mw and a number average molecular weight Mn;

the Mw is in the range of 25,000 to 60,000;

Mw/Mn is in the range of 5 to 10;

a ratio of an absorbance of the toner particles for a wavenumber of 1500 $cm^{-1}$ to an absorbance for a wavenumber of 720 $cm^{-1}$ is 0.6 or less;

a ratio of an absorbance of the toner particles for a wavenumber of 820 $cm^{-1}$ to the absorbance for a wavenumber of 720 $cm^{-1}$ is 0.4 or less; and in the cleaning unit, a variation in a load applied by the cleaning blade to the image holding member in a slide test is 1.5 gf/mm or less, in which in the slide test, an image holding member which has a diameter of 30 mm and with which the cleaning blade is in contact at a contact angle of 23° and a pressing pressure of 4.0 gf/mm is rotated 100,000 times at a rotational speed of 175 mm/sec to slide the cleaning blade.

2. The image forming apparatus according to claim 1, wherein the ratio of the absorbance of the toner particles for a wavenumber of 1500 $cm^{-1}$ to the absorbance for a wavenumber of 720 $cm^{-1}$ is 0.5 or less, and the ratio of the absorbance for a wavenumber of 820 $cm^{-1}$ to the absorbance for a wavenumber of 720 $cm^{-1}$ is 0.3 or less.

3. The image forming apparatus according to claim 1, wherein the ratio of the absorbance of the toner particles for a wavenumber of 820 $cm^{-1}$ to the absorbance for a wavenumber of 1500 $cm^{-1}$ is 0.5 or less.

4. The image forming apparatus according to claim 1, wherein the tetrahydrofuran-soluble component of the toner particles has a peak molecular weight ranging from 7,000 to 11,000.

5. The image forming apparatus according to claim 1, wherein an amount of a toluene-insoluble component contained in the toner particles is from 28 mass % to 38 mass %.

6. The image forming apparatus according to claim 1, wherein the toner particles contain a crystalline resin.

7. The image forming apparatus according to claim 6, wherein an amount of the crystalline resin is in the range of 3 mass % to 20 mass % relative to the amount of the whole toner.

8. The image forming apparatus according to claim 1, wherein the cleaning blade has a contact corner that is in contact with the image holding member and a non-contact corner that is a counter corner to the contact corner on the same end surface of the cleaning blade and that is not in contact with the image holding member, and micro hardness is higher at the contact corner than at the non-contact corner.

9. The image forming apparatus according to claim 8, wherein in the cleaning blade, a ratio ($M_T/M_N$) of the micro hardness at the contact corner ($M_T$) to the micro hardness at the non-contact corner ($M_N$) is in the range of 70/65 to 90/50.

10. The image forming apparatus according to claim 9, wherein part of the cleaning blade that is out of the contact corner and that includes the non-contact corner is cured.

11. The image forming apparatus according to claim 1, wherein the cleaning unit includes the cleaning blade of which a corner of one end is in contact with the image holding member to clean the image holding member, a supporting member that supports the cleaning blade and that is disposed so as to be movable in the direction in which a vibration of the cleaning blade that slides on the image holding member is absorbed, and a pressing unit having an elastic member that is pressed against the supporting member to press the supporting member so that the cleaning blade is pressed against the image holding member in the direction in which the supporting member is movable.

12. An image forming apparatus comprising:

an image holding member;

a charging unit that charges a surface of the image holding member;

an electrostatic charge image forming unit that forms an electrostatic charge image on the charged surface of the image holding member;

a developing unit that has an electrostatic charge image developer and that develops the electrostatic charge image on the surface of the image holding member with the electrostatic charge image developer to form a toner image;

a transfer unit that transfers the toner image formed on the surface of the image holding member to the surface of a recording medium; and a cleaning unit having a cleaning blade that is in contact with the surface of the image holding member to clean the surface of the image holding member, wherein:

the electrostatic charge image developer contains toner;

the toner contains toner particles, an external additive, and an amorphous polyester resin as a binder resin;

a tetrahydrofuran-soluble component of the toner particles has a weight average molecular weight Mw and a number average molecular weight Mn;

the Mw is in the range of 25,000 to 60,000;

Mw/Mn is in the range of 5 to 10;

a ratio of an absorbance of the toner particles for a wavenumber of 1500 $cm^{-1}$ to an absorbance for a wavenumber of 720 $cm^{-1}$ is 0.6 or less;

a ratio of an absorbance of the toner particles for a wavenumber of 820 $cm^{-1}$ to the absorbance for a wavenumber of 720 $cm^{-1}$ is 0.4 or less; and the cleaning unit includes the cleaning blade of which a corner of one end is in contact with the image holding member to clean the image holding member, a supporting member that supports the cleaning blade and that is disposed so as to be movable in the direction in which a vibration of the cleaning blade that slides on the image holding member is absorbed, and a pressing unit having an elastic member that is pressed against the supporting member to press the supporting member so that the cleaning blade is pressed against the image holding member in the direction in which the supporting member is movable.

13. The image forming apparatus according to claim 12, wherein the ratio of the absorbance of the toner particles for a wavenumber of 1500 $cm^{-1}$ to the absorbance for a wavenumber of 720 $cm^{-1}$ is 0.5 or less, and the ratio of the absorbance for a wavenumber of 820 $cm^{-1}$ to the absorbance for a wavenumber of 720 $cm^{-1}$ is 0.3 or less.

14. The image forming apparatus according to claim 12, wherein the ratio of the absorbance of the toner particles for a wavenumber of 820 $cm^{-1}$ to the absorbance for a wavenumber of 1500 $cm^{-1}$ is 0.5 or less.

15. The image forming apparatus according to claim 12, wherein the tetrahydrofuran-soluble component of the toner particles has a peak molecular weight ranging from 7,000 to 11,000.

16. The image forming apparatus according to claim 12, wherein an amount of a toluene-insoluble component contained in the toner particles is from 28 mass % to 38 mass %.

17. The image forming apparatus according to claim 12, wherein the toner particles contain a crystalline resin.

18. The image forming apparatus according to claim 17, wherein an amount of the crystalline resin is in the range of 3 mass % to 20 mass % relative to an amount of the whole toner.

19. The image forming apparatus according to claim 12, wherein in the cleaning unit, a variation in a load applied by the cleaning blade to the image holding member in a slide test is 1.5 gf/mm or less, wherein in the slide test, an image holding member which has a diameter of 30 mm and with which the cleaning blade is in contact at a contact angle of 23° and a pressing pressure of 4.0 gf/mm is rotated 100,000 times at a rotational speed of 175 mm/sec to slide the cleaning blade.

* * * * *